US006142398A

United States Patent [19]

Shefer et al.

[11] Patent Number: 6,142,398

[45] Date of Patent: Nov. 7, 2000

[54] APPARATUS FOR PRODUCING FRAGRANCE-CONTAINING LONG LASTING SOLID PARTICLE

[75] Inventors: Adi Shefer; Shmuel David Shefer, both of East Brunswick; Maureen S. Santoro, South Plainfield, all of N.J.

[73] Assignee: International Flavors & Fragrances Inc., New York, N.Y.

[21] Appl. No.: 09/475,976

[22] Filed: Dec. 30, 1999

Related U.S. Application Data

[62] Division of application No. 09/186,487, Nov. 5, 1998, Pat. No. 6,051,540.

[51] Int. Cl.[7] ..... B02C 1/00

[52] U.S. Cl. ..... 241/101.6; 62/322; 241/101.2; 510/101; 510/349; 510/445; 510/452; 510/515; 512/4; 700/3; 700/67; 700/164

[58] Field of Search ..... 62/322; 241/101.2, 241/101.6; 700/3, 67, 164; 510/101, 349, 445, 452, 515; 512/4

[56] References Cited

U.S. PATENT DOCUMENTS

| | | | |
|---|---|---|---|
| 5,506,201 | 4/1996 | McDermott et al. | 512/4 |
| 5,840,668 | 11/1998 | Behan et al. | 510/349 |
| 6,048,830 | 4/2000 | Gallon et al. | 510/349 |

*Primary Examiner*—Gregory R. Delcotto
*Attorney, Agent, or Firm*—Arthur L. Liberman

[57] ABSTRACT

A method and apparatus is disclosed for producing a fragrance-containing solid particle, capable of controllably releasing the fragrance to the environment in which the particle is contained, for incorporation into laundry detergents, fabric softener compositions and drier-added fabric softener articles.

1 Claim, 20 Drawing Sheets

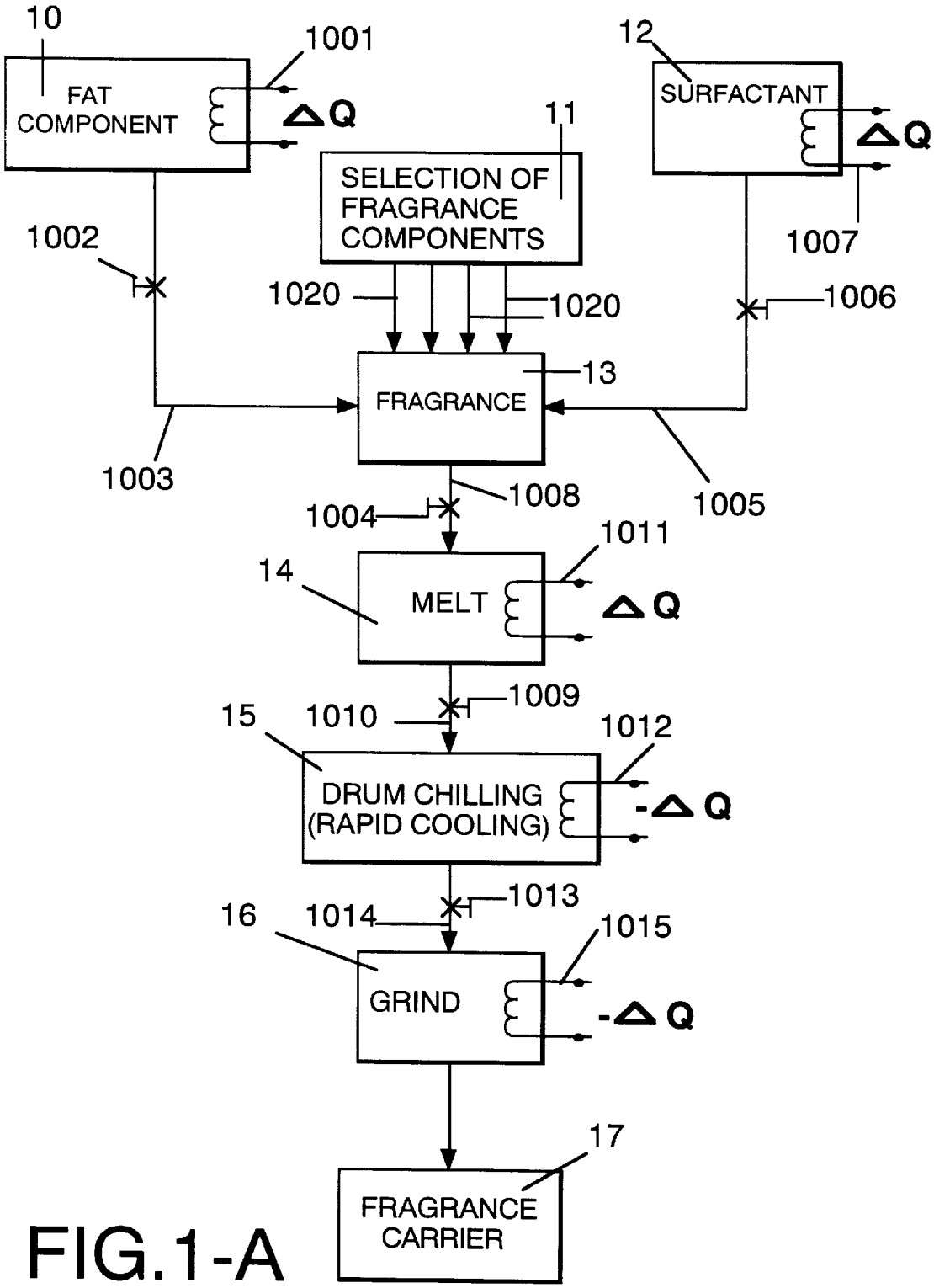
FIG.1-A

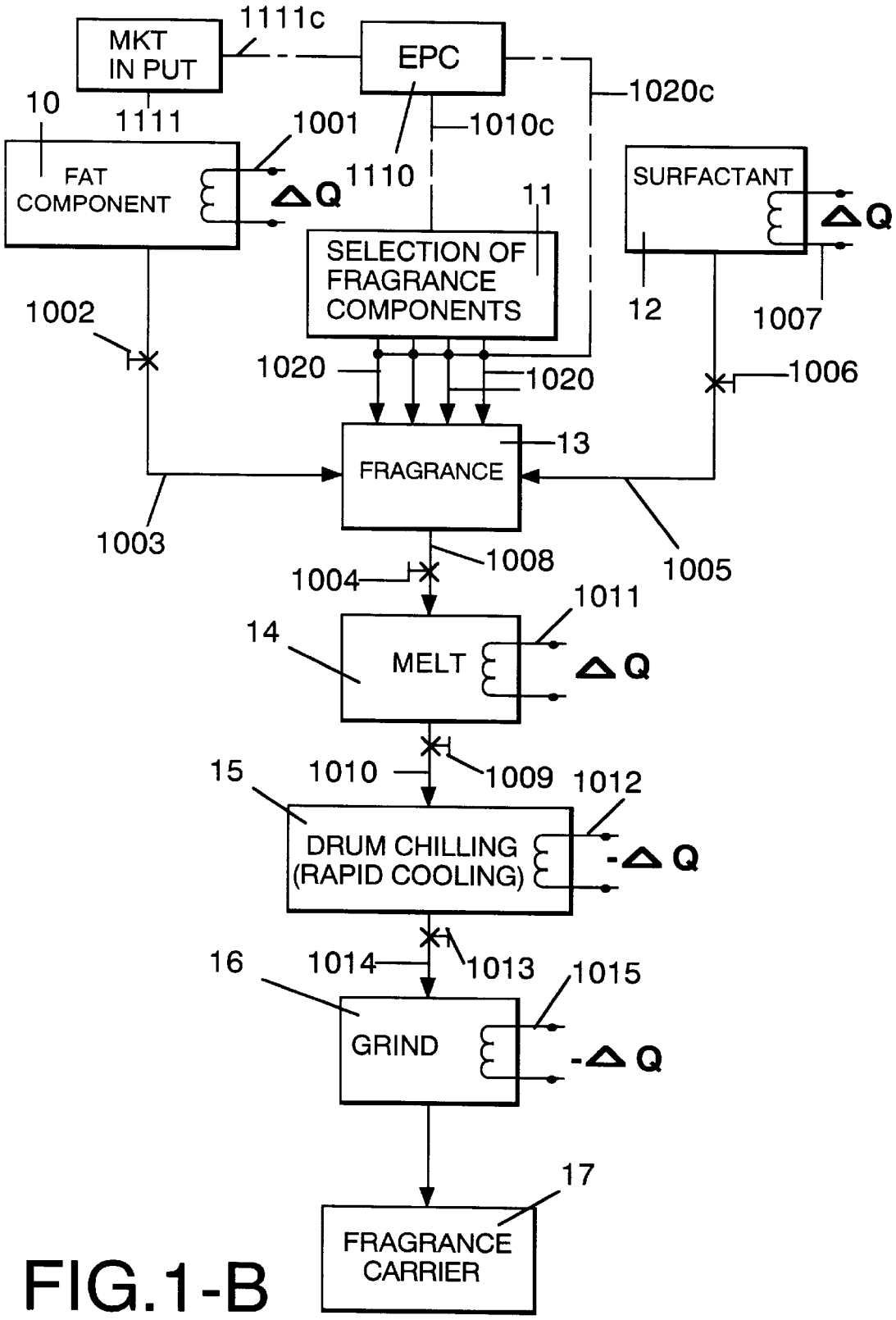
FIG.1-B

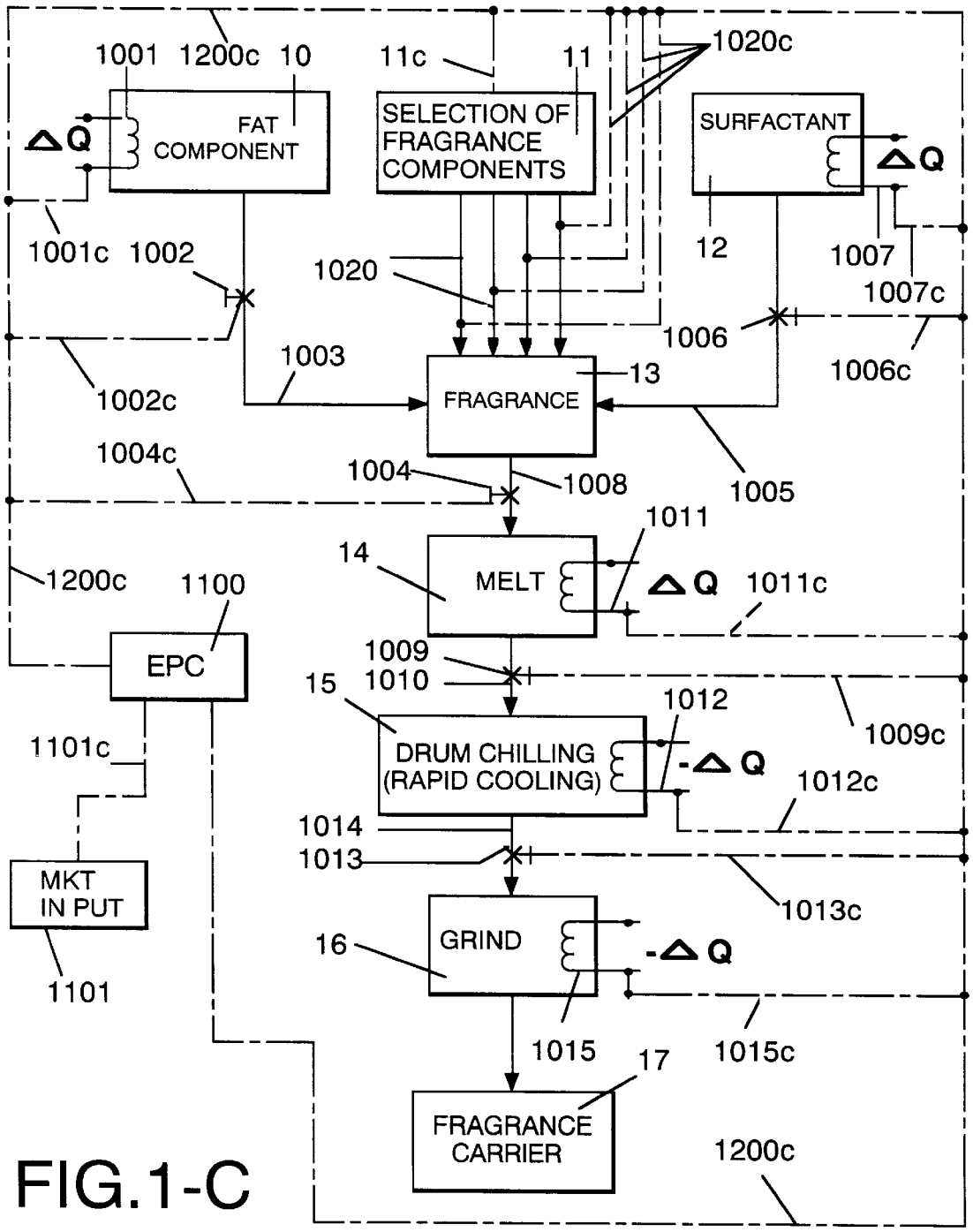
FIG.1-C

FIG. 13-A
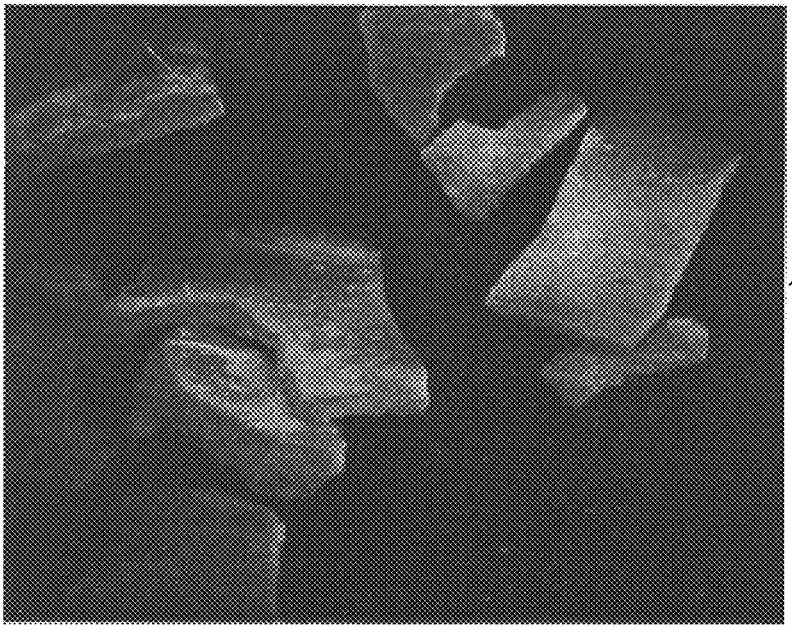
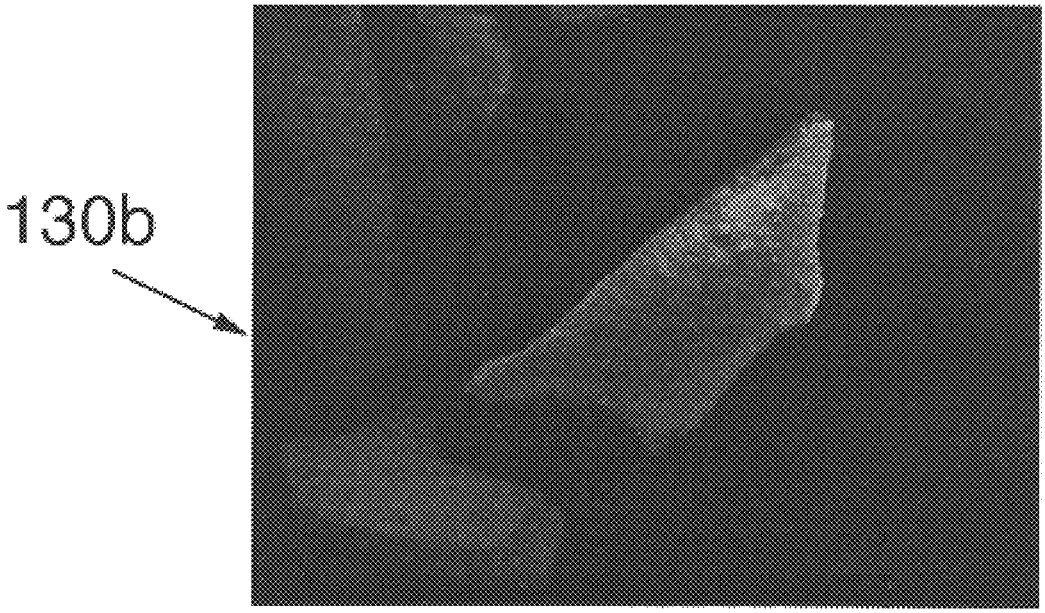
FIG. 13-B

FIG. 13-C
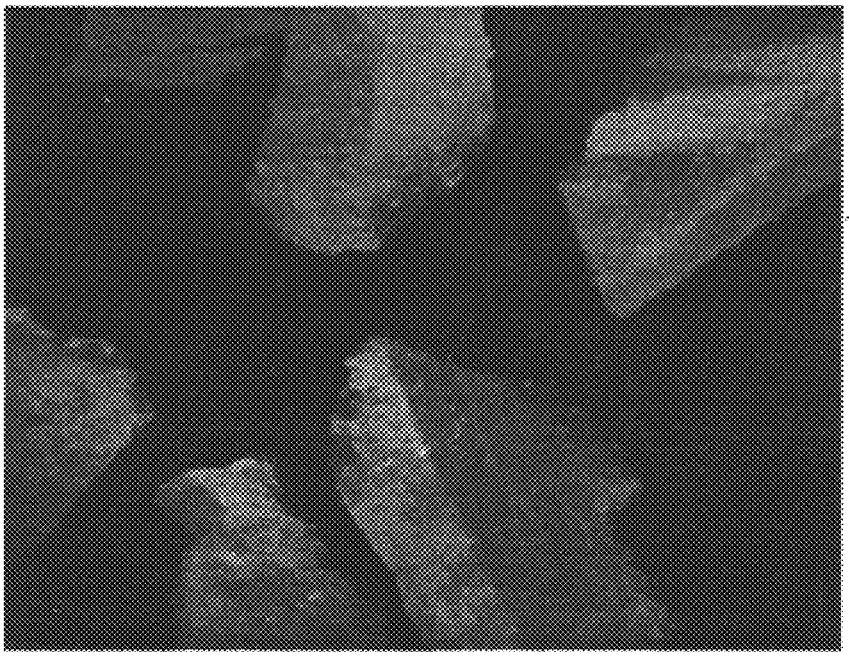
130c
FIG. 14
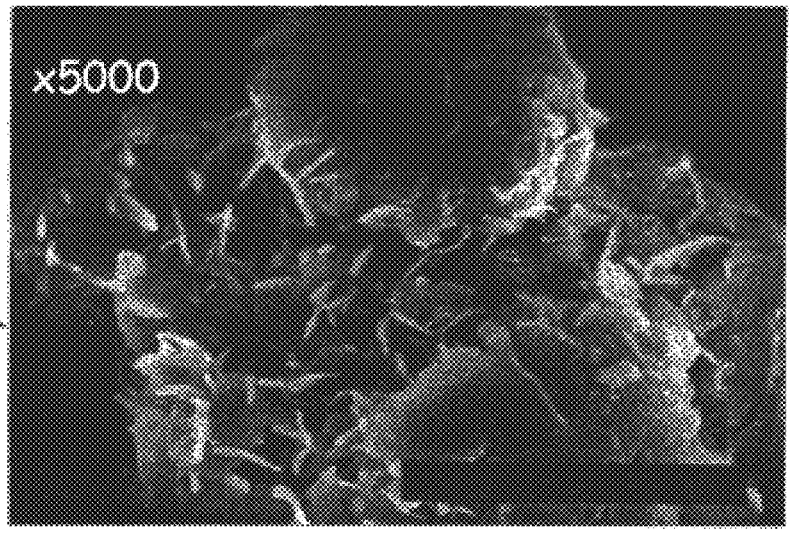
140

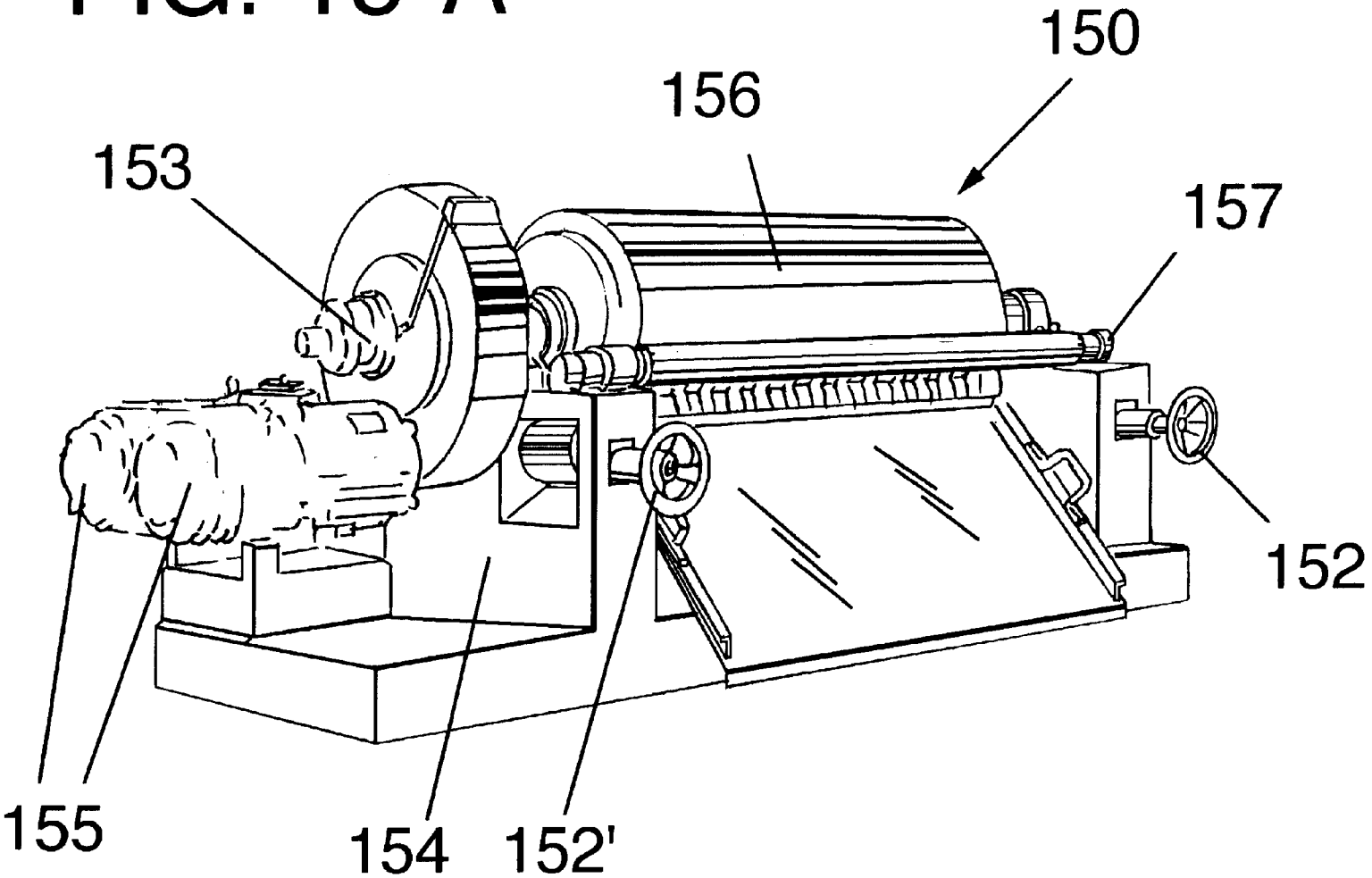
FIG. 15-A

FIG. 15-B
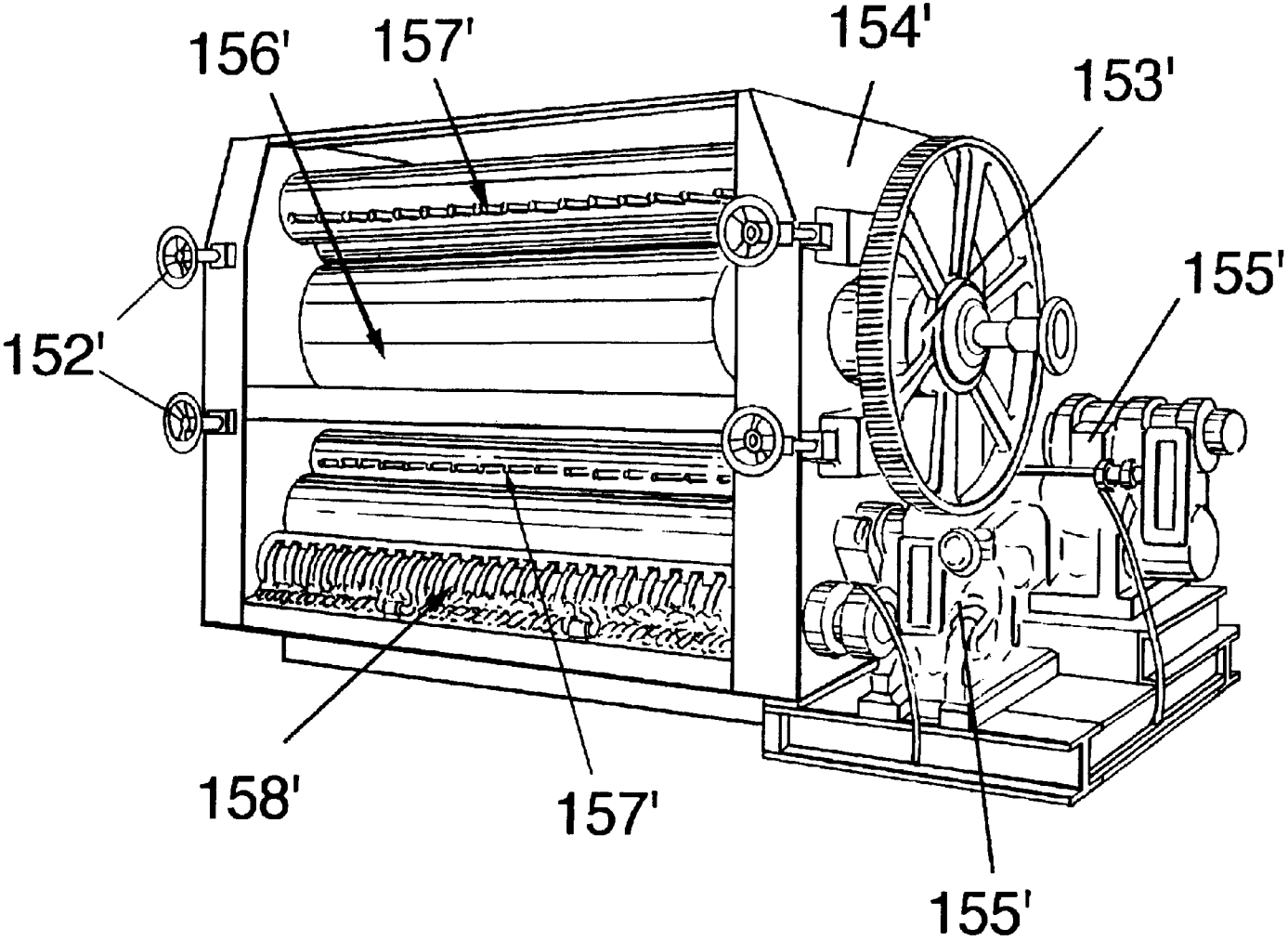

FIG. 16
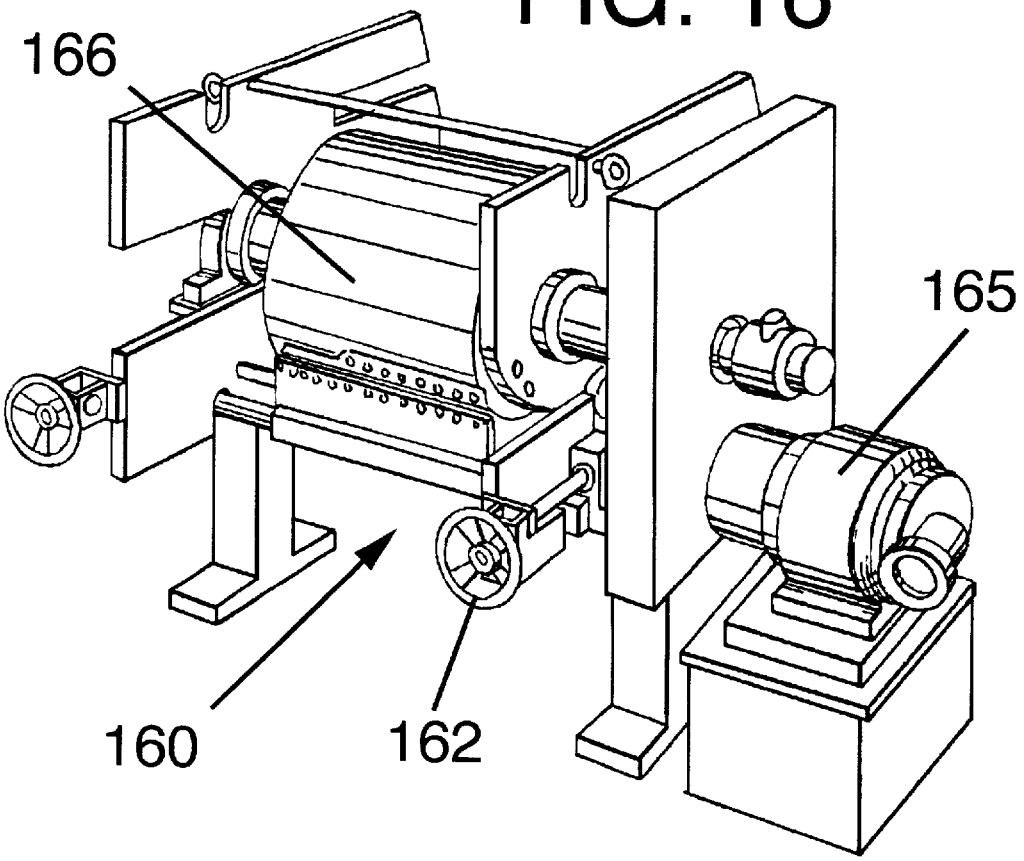
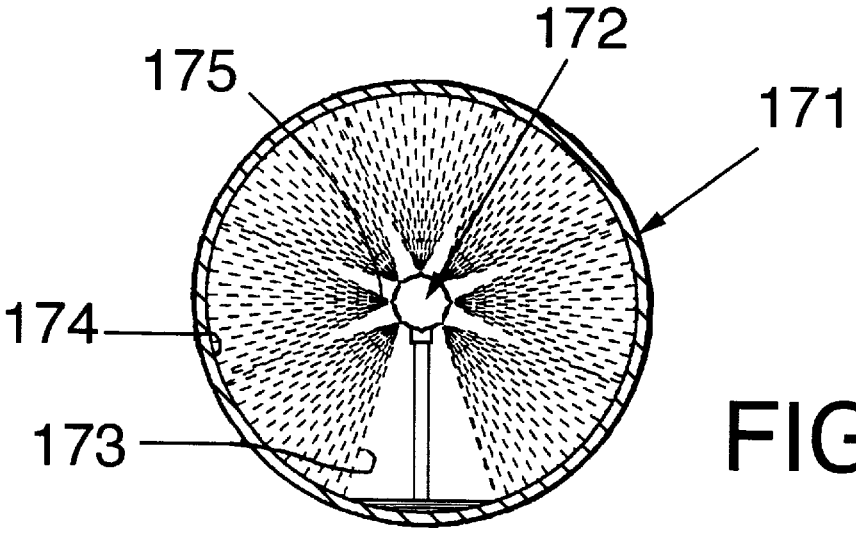
FIG. 17

APPARATUS FOR PRODUCING FRAGRANCE-CONTAINING LONG LASTING SOLID PARTICLE

This is a Divisional of application Ser. No. 09/186,487 filed on Nov. 5, 1998 now U.S. Pat. No. 6,051,540.

BACKGROUND OF THE INVENTION

The present invention relates to a formulation of a pre-selected fragrance formulation and a fat and a solid surface active agent for use as a carrier for the pre-selected fragrance formulation for the purpose of imparting a fragrance to a laundry detergent composition, a fabric softener composition or a drier-added fabric softener article containing the fragrance/fat/surface active agent formulation used to increase substantivity of fragrances on fabrics. In another aspect, the present invention relates to a method of formulating a pre-selected fragrance formulation and a fat and surface active agent carrier for the pre-selected fragrance formulation.

The method of the present invention enables the production of fragrance-containing solid particles of improved substantivity for use in a variety of laundry detergents, fabric softener compositions and drier-added fabric softener articles.

It has been the practice in the past to impart fragrance to standard powdered laundry detergents by simply spraying the fragrance or aroma chemical onto the detergent base formulation. In such prior art developments, it is typical that the detergent contains at least 0.5% by weight of the fragrance formulation. In the course of the washing process wherein clothes are washed with the standard powdered laundry detergent, a very small fraction of the fragrance that is contained in the detergent is actually transferred to the clothes. Tests have shown that the amount of fragrance that is left as a residue on the clothes can be as low as 1% of the original small amount of fragrance that is contained in the detergent formulation itself. Hence, it will be seen that 1% of as little as 0.5% by weight fragrance is a very small amount of fragrance indeed.

One approach to solve this problem that has been used in the prior art is to employ a carrier to bring the fragrance to the clothes. The carrier is formulated to contain fragrance and to attach itself to the clothes during the washing cycle through particle entrainment or chemical change.

Another technique is that disclosed in U.S. Pat. No. 5,506,201 issued on Apr. 9, 1996 (McDermott, et al) wherein a method is disclosed for producing a fragrance containing solid particle for incorporation into laundry detergents by selecting a fat component such as a fatty acid glyceride, heating the fat component to an elevated temperature sufficient to form a molten melt thereof, selecting a solid surface active agent from the group consisting of SPAN® surfactants with an HLB of 4.3 to 8.6, heating the surface active agent to form a molten melt thereof and then combining the melts with an aroma chemical to form a mixture. The resulting mixture is rapidly cooled to form a solid material, and the solid material is formed into particles and the particles are added to detergent formulations. The SPAN® surfactants of U.S. Pat. No. 5,506,201 are mixtures of materials having the structures:

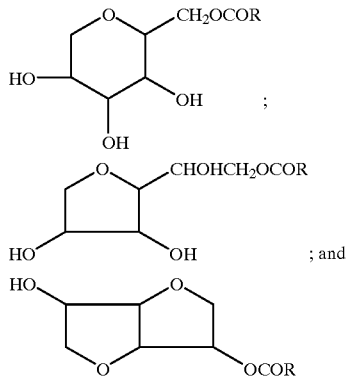

wherein R is $C_{11}$–$C_{17}$ alkyl or alkenyl. However, U.S. Pat. No. 5,506,201 does not recognize that in order to create intense long lasting fragrances which are substantive on cloth treated with detergents and/or fabric softeners and/or drier-added fabric softener articles, it is necessary to "pre-engineer" the fragrance in conjunction with the particular fragrance components, as well as the weight percentages of each component in the formulation and, in combination, formulate the fragrance-containing particle using a surfactant having an HLB of between 1 and 3 and, initially, drum chilling the fat/fragrance/surfactant combined molten mixture. Furthermore, the procedures of other prior art and formulations of other prior art have not been altogether successful because of the low substantivity of the fragrances. In the detergent industry, the term "substantivity" refers to the deposition of the fragrance on the clothes and the retention and perception of the fragrance on the laundered clothing and on the clothing treated with fabric softeners or drier-added fabric softener articles.

THE INVENTION

It is an object of the present invention to provide fragrances of improved substantivity by means of pre-selecting fragrance components utilizing an algorithm employing cumulative weight percentages of fragrance components as well as water-n-octanol partition coefficients of fragrance components and by utilizing a suitable carrier to bring the pre-selected fragrance formulation to clothes which have been laundered and/or which have been treated with fabric softeners and/or which have been treated with drier-added fabric softener articles.

It is a further object of the present invention to provide improved powdered laundry detergent and fabric softener formulations and drier-added fabric softener articles which result in improved substantivity of fragrances.

In obtaining the above and other objects, one feature of the present invention resides in pre-selecting a fragrance formulation and in formulating a fat and solid surface active agent carrier for the pre-selected fragrance formulation to be used in laundry detergents, fabric softener compositions and drier-added fabric softener articles.

More particularly, the method of the invention for producing a fragrance-containing solid particle of improved substantivity for incorporation into fabric softener compositions, laundry detergents and drier-added fabric softener articles is carried out by:

(a) selecting at least one fat component;

(b) heating the fat component(s) whereby a first melt is formed;

(c) selecting at least one surface active agent having an HLB value of from about 1 up to about 3;

(d) heating the surface active agent(s) whereby a second melt is formed;

(e) pre-selecting and blending at least ten fragrance components selected from the group consisting of aroma chemicals and essential oils according to an algorithm illustrated by a graph in the X-Y plane where the calculated $\log_{10}P$ (measured on the Y axis) for each given fragrance component $\Phi_i$ is a function of:

(i) the cumulative weight percentage of all fragrance components ($\Sigma(\text{wt. }\%)_i$) measured on the X axis having a $\log_{10}P$ less than or equal to that of the given fragrance component $\phi_i$;

(ii) the tangent slopes to the graph of $\log_{10}P$ vs. $\Sigma$(wt. %) illustrating the algorithm; and (iii) the Y intercept of the graph of the $\log_{10}P$ vs. $\Sigma$(wt. %) illustrating the algorithm;

to form a fragrance component blend;

(f) combining the first melt, the second melt and the pre-selected fragrance component blend to form a fragrance-melt blend;

(g) cooling the resulting fragrance-melt blend by means of drum chilling to form solid phase flakes; and (h) forming solid particles by means of cryogenically grinding the resulting solid phase flakes.

More specifically, our invention relates to a method for producing a fragrance-containing long lasting solid particle of improved substantivity for incorporation into:

(i) laundry detergents;

(ii) fabric softener compositions; and (iii) drier-added fabric softener articles consisting essentially of the steps of:

(a) selecting a fat component selected from the group consisting of partially hydrogenated soybean oil, partially hydrogenated cotton seed oil and partially hydrogenated palm oil or mixtures of same;

(b) heating the fat component(s) to an elevated temperature sufficient to form a first molten melt thereof;

(c) selecting a solid surface active agent which is preferably a SPAN® surfactant of HLB of from about 1 up to about 3, defined as a mixture of components having the structures:

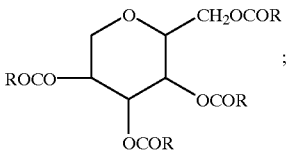

;

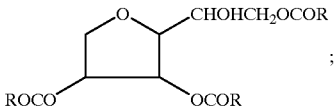

; and

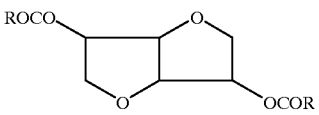

, wherein R is $C_{11}$–$C_7$ alkyl or alkenyl;

(d) heating said surface active agent to form a second molten melt thereof;

(e) preparing a fragrance formulation containing at least ten pre-selected components by using a mathematical algorithm to determine the cumulative weight percentages and water-n-octanol partition coefficients (P) of fragrance formulation components, selecting components that have calculated $\log_{10}P$'s which satisfy the algorithm and in amounts which satisfy the algorithm, and blending the thus selected components in order to form said fragrance formulation, whereby:

(a) the cumulative sum of weight percents of each of the fragrance components is a function of the $\log_{10}P$ of each fragrance component as defined by the equation:

$$\log_{10} P = M_0 + M_1 x + M_2 x^2 + M_3 x^3;$$

$x = \Sigma(\text{wt. }\%)$;

(b) the totality of the fragrance components has a pleasantness perception value of greater than 80 on a scale of 1–100; and (c) the totality of the fragrance components has an intensity perception value of greater than 80 on a scale of 1–100, wherein: P is the n-octanol-water partition coefficient for single fragrance component in the fragrance formulation; $\log_{10}P$ is measured on the Y axis; x is the cumulative sum of weight percentages of fragrance components in the fragrance formulation for a given value of $\log_{10}P$ shown thusly:

$x = \Sigma(\text{wt. }\%)$;

$M_0$ is the $\log_{10}P$ intercept of the curve defining the algorithm in the X-Y plane on the Y axis; $M_1$ is the root mean square of the tangent slopes to at least three points on the curve defining the algorithm at the "low" $\log_{10}P$ region of the curve defining the algorithm in the X-Y plane; $M_2$ is the root mean square of the tangent slopes to at least three points on the curve defining the algorithm at the "intermediate" $\log_{10}P$ region of the curve defining the algorithm in the X-Y plane; $M_3$ is the root mean square of the tangent slopes to at least three points on the curve defining the algorithm in the X-Y plane at the "high" $\log_{10}P$ region of the curve defining the algorithm in the X-Y plane; the "low" $\log_{10}P$ region of the curve is defined thusly: $-2<\log_{10}P\leqq 3.5$; the "intermediate" $\log_{10}P$ region of the curve is defined thusly: $3.5<\log_{10}P\leqq 5$; the "high" $\log_{10}P$ region of the curve is defined thusly: $5<\log_{10}P\leqq 8$;

(f) combining the first and second melts with the fragrance formulation and uniformly dispersing the fragrance formulation in the combined melt of the fat component and the surfactant;

(g) rapidly cooling, using drum chilling, the resulting mixture of melts and the pre-selected fragrance formulation to form a solid material containing the fat component, the SPAN® surface active agent and the pre-selected fragrance formulation; and (h) forming solid particles thereof by means of cryogenically grinding, each of which particles has an effective diameter of from about 0.3 up to about 0.8 microns, and each of which particle contains from about 1.0 up to about 20.0% by weight of the pre-selected fragrance formulation, from about 40 up to about 99% by weight of the fat component and from about 1 up to about 60% by weight of the surfactant.

Most preferably, the SPAN® surfactant useful in the practice of our invention is SPAN® 65 which is a mixture of compounds having the structures:

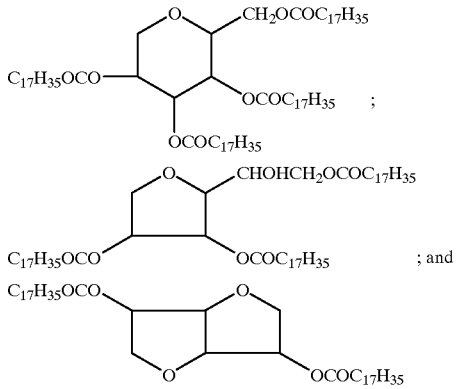

wherein the $C_{17}H_{35}$ moiety is a straight chain saturated alkyl moiety.

Preferably, the fat component is selected from natural fats obtained from solid waxy oils, from soybean, palm, corn, cotton seed, safflower and coconut plant sources.

Typically, the fat has the formula:

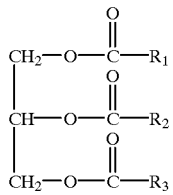

wherein $R_1$, $R_2$ and $R_3$ are the same or different $C_5$–$C_{30}$ alkyl or alkenyl.

In addition, the pre-selection of components for the fragrance formulation may also be governed by a second algorithm:

$$\sum_{i=10}^{1000} \log_{10} P_i = \sum_{j=10}^{1000} [M_{oj} + M_{1j}x_j + M_{2j}x_j^2 + M_{3j}x_j^3]$$

wherein $P_i$ is the water-n-octanol partition coefficient for an individual fragrance component; $M_{0j}$ is the $\log_{10}P$ intercept of the curve defining the algorithm in the X-Y plane on the Y axis; $M_{1j}$ is the tangent slope to the point on the curve [defining the algorithm at the "low $\log_{10}P$" region of the curve defining the algorithm in the X-Y plane] for an individual "low $\log_{10}P$" fragrance component; $M_{2j}$ is the tangent slope to the point on the curve [defining the algorithm at the "medium $\log_{10}P$" region of the curve defining the algorithm in the X-Y plane] for an individual "medium $\log_{10}P$" fragrance component; $M_{3j}$ is the tangent slope to the point on the curve [defining the algorithm at the "high $\log_{10}P$" region of the curve defining the algorithm in the X-Y plane] for an individual "high $\log_{10}P$" fragrance component; and $X_j$ is the cumulative sum of weight percentages of fragrance components in the fragrance formulation leading up to the point for the particular $\log_{10}P_i$ of the fragrance component on the curve defining the algorithm in the X-Y plane.

Our invention is also directed to apparatus used for producing a fragrance-containing long lasting solid particle of improved substantivity for incorporation into:

(i) laundry detergents;

(ii) fabric softener compositions; and (iii) drier-added fabric softener articles consisting essentially of:

(A) first containment means for maintaining a fat component selected from the group consisting of partially hydrogenated soybean oil, partially hydrogenated cotton seed oil and partially hydrogenated palm oil in the molten state;

(B) first heating means directly associated with said first containment means for heating said fat component located within said first containment means to an elevated temperature sufficient to form a first molten melt thereof;

(C) second containment means for maintaining a solid surface active agent which is a SPAN® surfactant of HLB of from about 1 up to about 3, defined as a mixture of compounds having the structures:

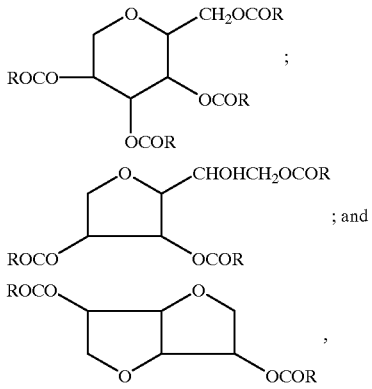

wherein R is $C_{11}$–$C_{17}$ alkyl or alkenyl in the molten state;

(D) second heating means directly associated with said second containment means for heating said surface active agent to form a second molten melt thereof;

(E) (i) data processing means directly associated with and directly communicating with first liquid feeding means for feeding fragrance formulation components into third containment means; and (ii) third containment means for preparing a fragrance formulation containing at least ten pre-selected components by following a mathematical algorithm whereby:

(a) the cumulative sum of the weight percents of each of the fragrance components is a function of the $\log_{10}P$ of each fragrance component as defined by the equation:

$$\log_{10} P = M_0 + M_1x + M_2x^2 + M_3x^3;$$

$$x = \Sigma(\text{wt. } \%);$$

(b) the totality of the fragrance components has a pleasantness perception value of greater than 80 on a scale of 1–100; and (c) the totality of the fragrance components has an intensity perception value of greater than 80 on a scale of 1–100, wherein:

$M_0$ is the intercept of the curve defining the algorithm in the X-Y plane on the Y axis; $M_1$ is the root mean square of the tangent slopes to at least three points on the curve defining the algorithm at the "low" $\log_{10}P$ region of the curve defining the algorithm in the X-Y plane; $M_2$ is the root mean square of the tangent slopes to at least three points on the curve defining the algorithm at the "intermediate" $\log_{10}P$ region of the curve defining the algorithm in the X-Y plane; $M_3$ is the root mean square of the tangent slopes to at least three points on the curve defining the algorithm in the X-Y plane at the "high" $\log_{10}P$ region of the curve defining the algorithm in the X-Y plane; the "low" $\log_{10}P$ region of the curve is defined thusly: $-2<\log_{10}P<3.5$; the "intermediate" $\log_{10}P$ region of the curve is defined thusly: $3.5<\log_{10}P\leqq 5$; and the "high" $\log_{10}P$ region of the curve is defined thusly: $5<\log_{10}P\leqq 8$;

(F) second liquid feeding means, fourth containment means and mixing means directly associated with said fourth containment means for combining said first and second melts with said fragrance formulation previously formed in said third containment means and uniformly dispersing said fragrance formulation in the combined melt of said fat component and said surfactant; whereby said first and second melts and said fragrance formulation are fed via said second feeding means into said fourth containment means;

(G) drum chilling means and fifth feeding means for rapidly cooling the resulting mixture of melts to form a solid material containing said fat component, said SPAN® surface active agent and said pre-selected fragrance formulation, whereby said mixture of first and second melts and said fragrance formulation is transported from said fourth containment means into said drum chilling means; and (H) particle forming means associated with the output of said drum chilling means for forming solid particles, each of which particle has an effective diameter of from about 0.3 up to about 0.8 microns; and each of which particle contains from about 1.0 up to about 20.0% by weight of said fragrance formulation; from about 40 up to about 99% by weight of said fat component and from about 1 up to about 60% by weight of said SPAN® surfactant component.

In the method of our invention, the pre-selected fragrance formulation may be prepared using a computer program based on the algorithm. Furthermore, the particles of our invention may also be prepared using a computer program, particularly as illustrated in FIG. 1C, described in detail, infra.

The process step for carrying out the drum chilling and the means for drum chilling as set forth, supra, preferably employ drum chilling apparatus as illustrated in FIGS. 2, 3, 15A, 15B, 16 and 17, described in detail, infra. Examples of such drum chilling apparatus are BUFLOVAK® Cooling Drum Flakers produced by the BUFLOVAK® Division of Buffalo Technologies Corporation, P.O. Box 1041, Buffalo, N.Y. 14240 and described in Buffalo Technologies Corporation's *BULLETIN* DF0989. Most preferably, such drum chilling apparatus is operated at 6 to 8 revolutions per minute using internal water coolant having a temperature of between 5 and 20° C. Such apparatus is also described in detail in the *Chemical Engineers' Handbook*, Third Edition, published by the McGraw-Hill Book Company, Inc., 1950 (John H. Perry, Ph.D., Editor) at pages 862–868.

Referring to the pre-selected fragrance formulation ingredients, the following Tables I, II and III set forth, respectively, the "high $\log_{10}P$" range of components, "intermediate $\log_{10}P$" components and "low $\log_{10}P$" components, respectively:

TABLE I

HIGH $\log_{10}P$ COMPONENTS

| Ingredients | $\log_{10}P$ |
|---|---|
| Ambrettolide | 6.261 |
| β-Caryophyllene | 6.333 |
| Cadinene | 7.346 |
| Cedryl acetate | 5.436 |
| Cedryl formate | 5.070 |
| Cinnamyl cinnamate | 5.480 |
| Cyclohexyl salicylate | 5.265 |
| EXALTOLIDE ® (trademark of Firmenich et Cie of Geneva, Switzerland) (cyclopentadecanolide) | 5.346 |
| GALAXOLIDE ® (trademark of International Flavors & Fragrances Inc. of New York, NY, U.S.A.) (mixture of compounds having the structures: | 5.482 |

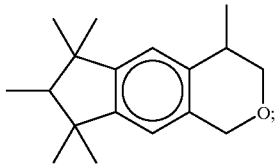

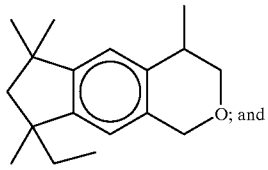

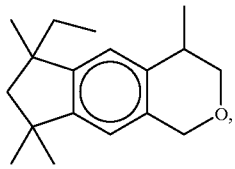

| | |
|---|---|
| Geranyl phenyl acetate | 5.233 |
| Hexadecanolide | 6.805 |
| Hexyl dinnamic aldehyde | 5.473 |
| Hexyl salicylate | 5.260 |
| Linalyl benzoate | 5.233 |
| CELESTOLIDE ® (trademark of International Flavors & Fragrances Inc. of New York, NY, U.S.A.) (the compound having the structure: | 5.458 |

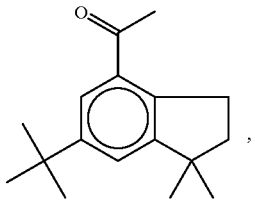

| | |
|---|---|
| PHANTOLIDE ® (trademark of Polak's Frutal Works of Amstelveene, Netherlands) (the compound having the structure: | 5.977 |

TABLE I-continued

| HIGH $log_{10}P$ COMPONENTS | |
|---|---|
| Ingredients | $log_{10}P$ |
| 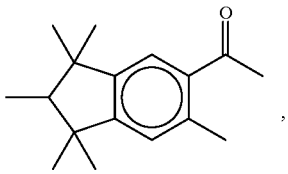 , | |
| THIBETOLIDE ™ (trademark of Givaudan, Division of Hoffman LaRoche of Nutley, New Jersey) | 6.246 |
| Ylangene | 6.268 |

TABLE II

| FRAGRANCE COMPONENTS HAVING AN "INTERMEDIATE $log_{10}P$" | |
|---|---|
| Ingredients | $log_{10}P$ |
| Allyl cyclohexane propionate | 3.935 |
| Amyl cinnamate | 3.771 |
| Amyl cinnamic aldehyde | 4.324 |
| Amyl cinnarnic aldehyde dimethyl acetal | 4.033 |
| iso-Amyl salicylate | 4.601 |
| Aurantiol | 4.216 |
| Benzyl salicylate | 4.383 |
| VERTENEX HC ® (trademark of International Flavors & Fragrances Inc. of New York, NY, U.S.A.) (compound having the structure: | 4.019 |
| 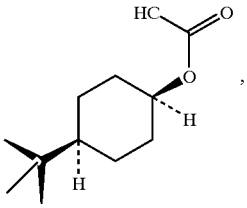 , | |
| iso-Butyl quinoline | 4.193 |
| Cedrol | 4.530 |
| Cyclamen aldehyde | 3.680 |
| Diphenyl methane | 4.059 |
| Diphenyl oxide | 4.240 |
| Dodecalactone | 4.359 |
| Ethylene brassylate | 4.554 |
| Ethyl undecylenate | 4.888 |
| Geranyl anthranilate | 4.216 |
| Hexenyl salicylate | 4.716 |
| α-Irone | 3.820 |
| LILIAL ® (Trademark of Givaudan, Division of Hoffman LaRoche of Nutley, New Jersey, U.S.A.) (compound having the structure: | 3.858 |

TABLE II-continued

| FRAGRANCE COMPONENTS HAVING AN "INTERMEDIATE $log_{10}P$" | |
|---|---|
| Ingredients | $log_{10}P$ |
| 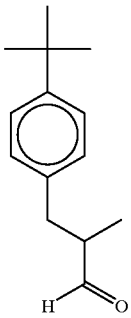 , | |
| Methyl dihydrojasmone | 4.843 |
| γ-n-Methyl ionone | 4.309 |
| Musk tibetine | 3.831 |
| Oxahexadecanolide-10 | 4.336 |
| Oxahexadecanolide-11 | 4.336 |
| Patchouli alcohol | 4.530 |
| Phenyl ethyl benzoate | 4.058 |
| Phenylethylphenyl acetate | 3.767 |
| α-Santalol | 3.800 |
| δ-Undecalactone | 3.830 |
| γ-Undecalactone | 4.140 |
| Vetiveryl acetate | 4.882 |
| β-Pinene | 4.600 |
| p-Cymene | 4.068 |
| Geranyl acetate | 3.715 |
| d-Limonene | 4.232 |
| Linalyl acetate | 3.500 |
| VERTENEX ® (trademark of International Flavors & Fragrances Inc. of New York, NY, U.S.A.) | 4.060 |

TABLE III

| FRAGRANCE COMPONENTS HAVING A "LOW $log_{10}P$" | |
|---|---|
| Ingredients | $log_{10}P$ |
| Amyl benzoate | 3.417 |
| Benzophenone | 3.120 |
| Dihydro isojasmonate | 3.009 |
| JSO E SUPER ® (trademark of International Flavors & Fragrance Inc. of New York, New York, U.S.A.) (compound having the structure: | 3.455 |
| 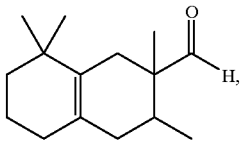 | |
| Ethyl methyl phenyl glycidate | 3.165 |
| 2-Methoxy naphthalene | 3.235 |
| Musk ketone having the structure: | 3.014 |
| 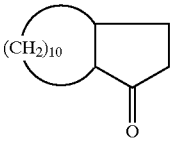 | |
| Myristicin | 3.200 |
| Phenyl heptanol | 3.478 |

TABLE III-continued

FRAGRANCE COMPONENTS HAVING A "LOW $\log_{10}P$"

| Ingredients | $\log_{10}P$ |
|---|---|
| Phenyl hexanol | 3.299 |
| Yara-yara | 3.235 |
| Benzaldehyde | 1.480 |
| Benzyl acetate | 1.960 |
| 1-Carvone | 2.083 |
| Geraniol | 2.649 |
| Hydroxycitronellal | 1.541 |
| cis-Jasmone | 2.712 |
| Linalool | 2.429 |
| Nerol | 2.649 |
| β-phenyl ethyl alcohol | 1.183 |
| α-Terpineol | 2.569 |
| Coumarin | 1.412 |
| Eugenol | 2.307 |
| iso-Eugenol | 2.547 |
| Indole | 2.142 |
| Methyl cinnamate | 2.620 |
| Methyl dihydrojasmonate | 2.275 |
| Methyl-N-methyl anthranilate | 2.791 |
| β-Methyl naphthyl ketone | 2.275 |
| 6-Nonalactone | 2.760 |
| Vanillin | 1.580 |
| iso-Bornyl acetate | 3.485 |
| Carvacrol | 3.401 |
| α-Citronellol | 3.193 |
| Dihydro myrcenol | 3.030 |
| Ethyl tiglate | 2.000 |

The fragrance formulation used in the practice of our invention will contain at least three components from Table I, at least three components from Table II and at least three components from Table III with a minimum of ten components and a maximum of 1,000 components.

The maximum vapor pressure for the fragrance ingredients in the composition of our invention should be 4.1 mm/Hg at 30° C. The fragrance will have topnote components, middle note components and bottom note components. The vapor pressure ranges for each of these three groups of components coincides, for the most part, with the components of Table I, Table II and Table III and is as follows:

(a) with respect to the bottom note components, the vapor pressure range should be from 0.0001 mm/Hg up to 0.009 mm/Hg at 25° C.;

(b) with respect to the middle note components, the vapor pressure range of the middle note components should be from 0.01 mm/Hg up to 0.09 mm/Hg at 25° C.; and (c) with respect to the topnote components, the vapor pressure range of the topnote components should be from 0.1 mm/Hg up to 2.0 mm/Hg at 25° C.

The n-octanol/water partitioning coefficient of a perfume material indicated by the term P is the ratio between its equilibrium concentrations in n-octanol and in water. The perfume materials of our invention have an n-octanol/water partitioning coefficient P of between about $10^{-2}$ and about $10^{8}$. Since the partitioning coefficients of the perfume compositions of this invention have values of between $10^{-2}$ and $10^{8}$, they are more conveniently given in the form of their logarithm to the base 10, $\log_{10}P$. Thus, the perfume materials useful in the practice of our invention have a $\log_{10}P$ of between about −2 and about 8 as indicated, supra, and as indicated in the algorithm, set forth, supra, and also as indicated in FIGS. 4–12, described, infra.

The $\log_{10}P$ of many perfume ingredients have been reported; for example, the Pomona 92 database, available from Daylight Chemical Information Systems, Inc. (Daylight CIS), Irvine, Calif., contains many, along with citations to the original literature. However, the $\log_{10}P$ values are most conveniently calculated by the "CLOGP" program, also available from Daylight CIS. This program also lists experimental $\log_{10}P$ values when they are available in the Pomona 92 database. The "calculated $\log_{10}P$" is determined by the fragment approach of Hansch and Leo (*Comprehensive Medicinal Chemistry*, Volume 4, C. Hansch, P. G. Sammens, J. B. Taylor and C. A. Ramsden, Editors, page 295, Pergamon Press, 1990, incorporated by reference herein). The fragment approach is based on the chemical structure of each component of the perfume material and takes into account the numbers and types of atoms, the atom connectivity and the chemical bonding. The calculated $\log_{10}P$ values, which are the most reliable and widely used estimates for this physicochemical property, are preferably used instead of the experimental $\log_{10}P$ values in the selection of perfume materials useful in the practice of our invention and as set forth in Table I, Table II and Table III.

It is to be emphasized herein that the components as set forth in Tables I, II and III, supra, are examples and our invention is not to be limited by these tables.

BRIEF DESCRIPTION OF THE DRAWINGS

FIG. 1A is another schematic block flow diagram showing the process of our invention in more detail.

FIG. 1B is another schematic block flow diagram showing the process of our invention where the selection of fragrance components is controlled using an electronic data processing system and computer program which also measures market research information in order to effect commercial viability to the selected fragrance formulation.

FIG. 1C is another schematic block flow diagram showing the process of our invention controlled by means of an electronic program controlling apparatus wherein market input enables the creation of particles which cause the resulting product to have a greater chance of commercial success.

$$x=\Sigma(\text{wt. }\%),$$

for calculating one of the points for determination of $M_3$, the root mean square of the tangent slope to at least three points at the "high" $\log_{10}P$ region of the curve defining the algorithm in the X-Y plane, that is:

$$M_{3j}=\frac{\Delta\log_{10}P_i}{\Delta x};\quad M_{3j}=\frac{\Delta\log_{10}P_i}{\Delta\Sigma(\text{wt. }\%)_i}.$$

FIGS. 13A and 13B are photomicrographs of flake product evolving from the drum chilling step at ×35 magnification.

FIG. 13C is a photomicrograph of a flake product evolving from the drum chilling step of the process of our invention at ×50 magnification.

FIG. 14 is a photomicrograph at ×5,000 magnification of cryogenically ground particles evolving from the grinding step of the process of our invention.

FIGS. 15A and 15B are perspective views of drum chilling apparatus useful in the practice of our invention.

FIG. 16 is a perspective view of another embodiment of drum chilling apparatus used in the practice of our invention.

FIG. 17 is a schematic cutaway side elevation view of the drum portion of the drum chilling apparatus used in the practice of the process and in the apparatus of our invention.

DETAILED DESCRIPTION OF THE DRAWINGS

Figure 1:
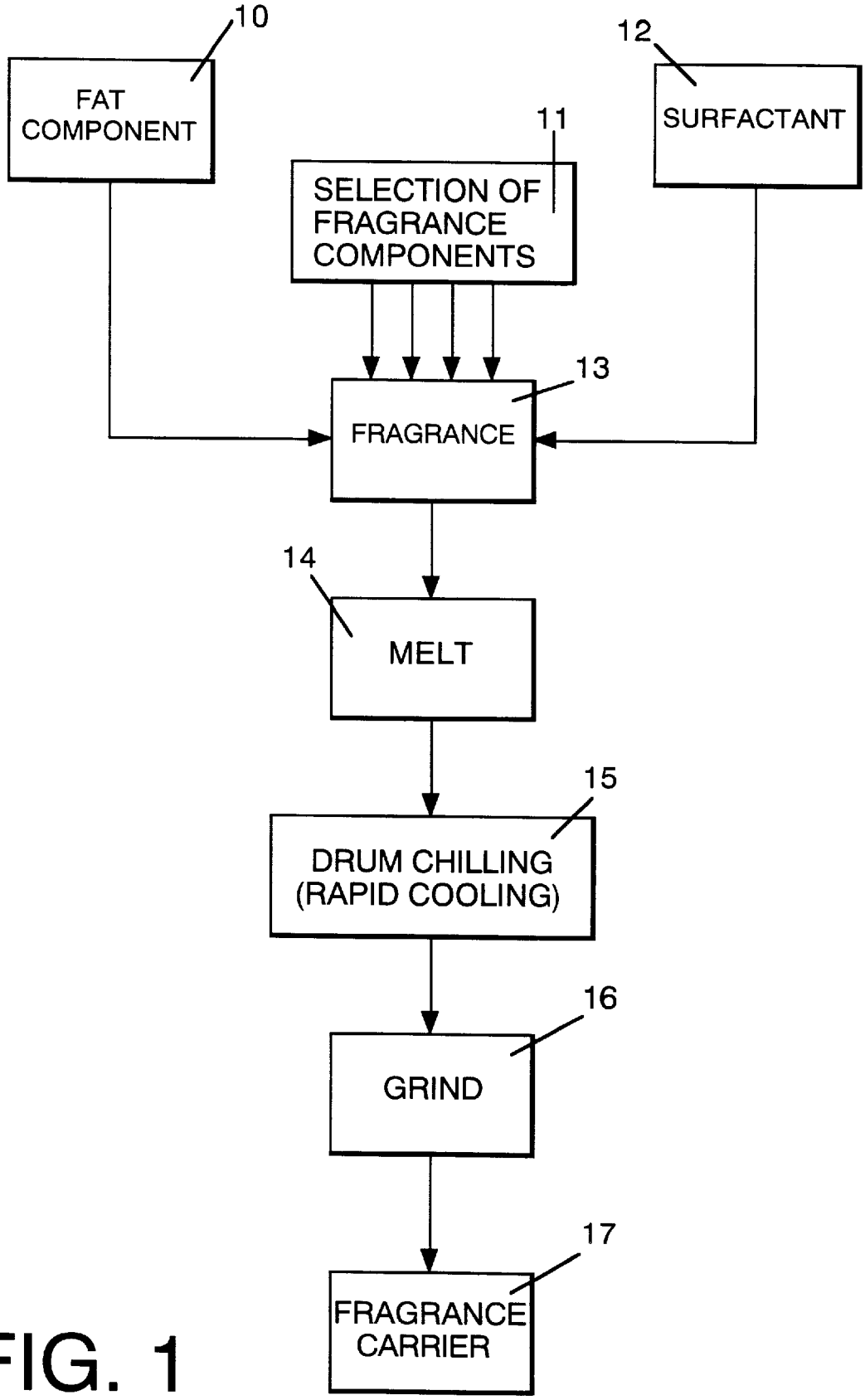
FIG. 1 is a schematic block flow diagram showing, in schematic form, the process of our invention.

Referring to FIG. 1, fat component, for example, partially hydrogenated soybean oil, e.g., DURKEE® D17 Fat produced by the Durkee Foods Division, from a location indicated by reference numeral 10 is combined with surfactant (e.g., SPAN® 65, sorbitan tristearate manufactured by Imperial Chemical Industries Surfactants Division) from a location indicated by reference numeral 12 each in molten state is combined with a pre-selected fragrance wherein the components flow from location 11 according to the mathematical algorithm:

$$\log_{10} P=M_0+M_1+M_2x^2+M_3x^3;$$

$$x=\Sigma(\text{wt. }\%),$$

to a vessel indicated by reference numeral 13 into a vessel indicated by reference numeral 14. The resulting fragrance-fat component-surfactant melt is then fed to a drum chilling apparatus 15 from which flakes are emitted. The drum chilled flakes are then ground cryogenically using, for example, liquid nitrogen and/or liquid carbon dioxide, using cryogenic grinder 16 and then fed into a fragrance carrier 17 such as a powder detergent, or the particles are suspended in a liquid detergent, or the particles are added to a powder fabric softener or a formulation to create a drier-added fabric softener article (e.g., BOUNCE®, manufactured by the Procter & Gamble Company of Cincinnati, Ohio).

Referring to FIG. 1A, the fat component is shown to be heated to molten state by heating element 1001 and then passed through line 1003 past control valve 1002 into vessel 14 which is also heated using heating element 1011. Simultaneously, surfactant from location 12 heated to the molten state by heating element 1007 is passed through line 1005 past control valve 1006 into vessel 14. Simultaneously, fragrance components from location 11 are passed through lines 1020 into vessel 13 according to algorithm:

$$\log_{10} P=M_0+M_1x+M_2x^2+M_3x^3;$$

$$x=\Sigma(\text{wt. }\%),$$

and the fragrance formulation is then passed through line 1008 past valve 1004 into vessel 14. The fragrance-melt composition is then passed from vessel 14 through line 1010 past valve 1009 into drum chilling apparatus 15 which is cooled by cooling means 1012. The drum chilled flakes which evolved from the drum chilling apparatus are passed through line 1014 past valve 1013 to cryogenic grinder 16 which is cooled using cryogenic cooling means 1015 (e.g., liquid nitrogen and/or liquid carbon dioxide) through cooling coils. The resulting particles are then added to fragrance carrier at location 17.

Referring to FIG. 1B, FIG. 1B is identical to FIG. 1A except that the selection of fragrance components to formulate the fragrance formulation held in vessel 13 is controlled with electronic program controller 1110 which also has marketing input from software 1111 via input line 1111*c*. The electronic program controller controls the selection of fragrance components using algorithm:

$$\log_{10} P=M_0+M_1x+M_2x^2+M_3x^3;$$

$$x=\Sigma(\text{ wt. }\%)$$

via line 1110*c* and via line 1020*c*.

FIG. 1C is identical to FIG. 1B with the exception that the electronic program controller 1100 (computer hardware) controls the entire process using, inter alia, the algorithm:

$$\log_{10} P=M_0+M_1x+M_2x^2+M_3x^3;$$

$$x=\Sigma(\text{ wt. }\%).$$

Heat input 1001 is controlled through line 1001*c* which in turn is connected to the electronic program controller via line 1200*c*. Valve 1002 which controls the flow of molten fat is controlled through line 1002*c* to the electronic program controller. Valve 1006 which controls the flow of molten surfactant into vessel 14 is controlled by the electronic program controller via line 1006*c*. Heat input for maintaining the surfactant in molten stage 1007 is controlled through electronic program controller line 1007*c*. As stated, supra, the selection of fragrance components using algorithm:

$$\log_{10} P=M_0+M_1x+M_2x^2+M_3x^3;$$

$$x=\Sigma(\text{ wt. }\%),$$

is controlled through lines 11*c* and lines 1020*c*. The flow of pre-selected fragrance formulation from vessel 13 to vessel 14 for combination with the fat melt and surfactant melt through valve 1004 is controlled by the electronic program controller through line 1004*c*. The heat input to maintain the fragrance-melt formulation in molten state 1011 is controlled via electronic program controller line 1011*c*. The flow of the fragrance-melt formulation to the drum chilling apparatus 15 is controlled by valve 1009 which is controlled through electronic program controller line 1009*c*. The cooling rate for the drum chilling apparatus through cooling means 1012 is controlled through electronic program controller line 1012*c*. The rate at which the drum chilled flakes are fed into the cryogenic grinding apparatus via valve 1013 is controlled through electronic program controller line 1013*c*. The cooling rate for the cryo-grinding apparatus 16 is controlled via cooling means 1015 (liquid nitrogen and/or liquid carbon dioxide cooling coils) and controlled through electronic program controller line 1015*c*.

Figure 2:
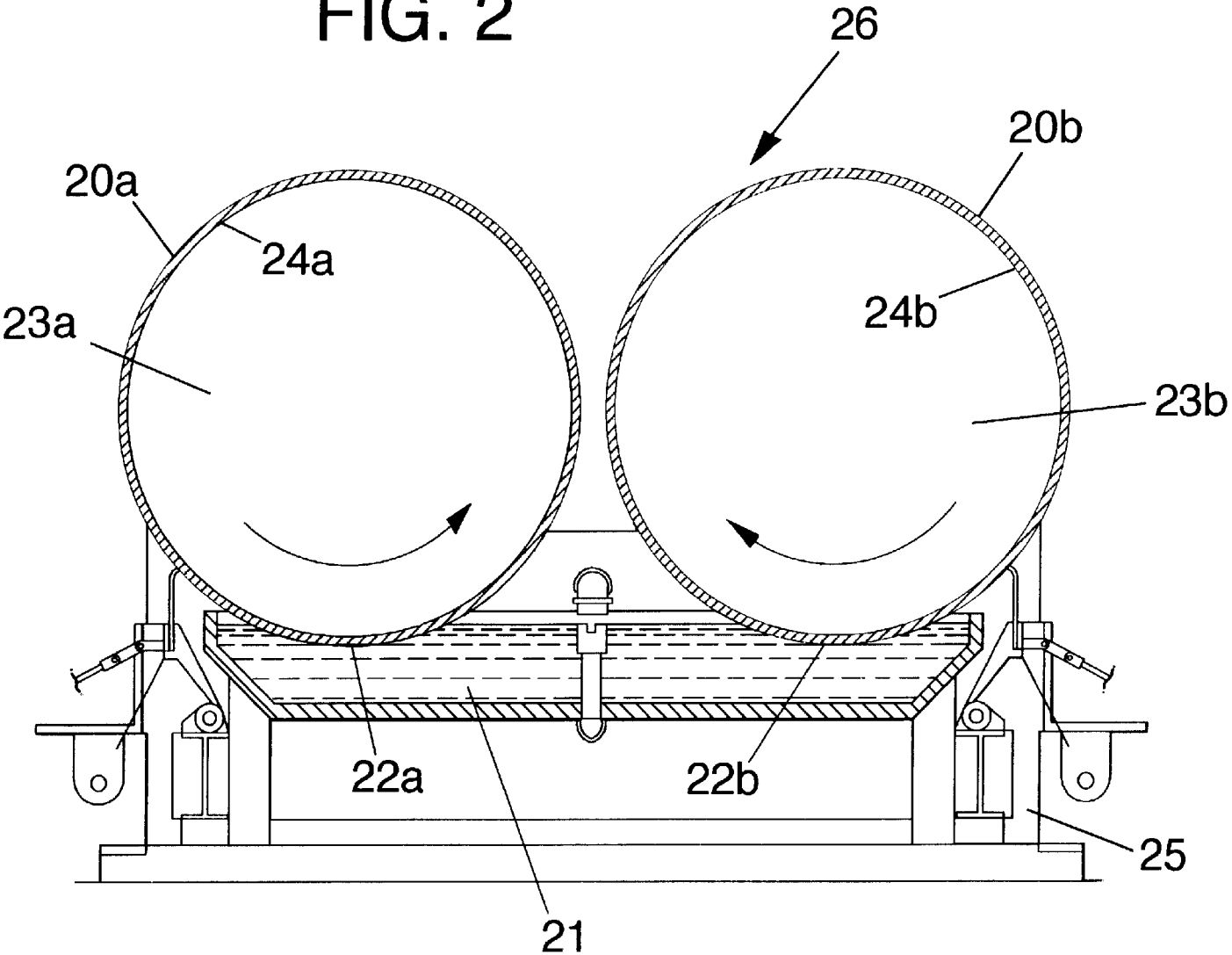
FIG. 2 is a cutaway side elevation view of an embodiment of drum chilling apparatus useful in the practice of our invention.

The drum chiller apparatus shown in FIG. 2 is a twin-drum chilling apparatus with dip feed manufactured by BUFLOVAK® Division of Buffalo Technologies Corporation, Buffalo, N.Y. Perfume composition-fat composition-surfactant in the liquid phase at location 21 is coated onto drums 20*a* and 20*b* at locations 22*a* and 22*b*, respectively. Simultaneously, the internal void of each of the drums is cooled via an aqueous cooling spray which impinges upon the inner surfaces of each of the drums, 24*a* and 24*b*, respectively. Drum 20*a* rotates in counterclockwise fashion and drum 20*b* rotates in clockwise fashion. The liquid melt-fragrance mixture 21 is fed into location 21 from vessel 14 through line 1010 (FIG. 1B) controlled through control valve 1009 (FIG. 1B). The twin drum chilling apparatus 26 is held on platform 25. Internal void of drum 20*a*, indicated by reference numeral 23*a*, contains a spraying device (as shown in detail in FIG. 17) where the cooling spray impinges upon the inner wall of the drum, indicated by reference numeral 24*a*. The cooling spray in drum 20*b* impinges on the inner wall thereof, indicated by reference numeral 24*b*.

Figure 3:
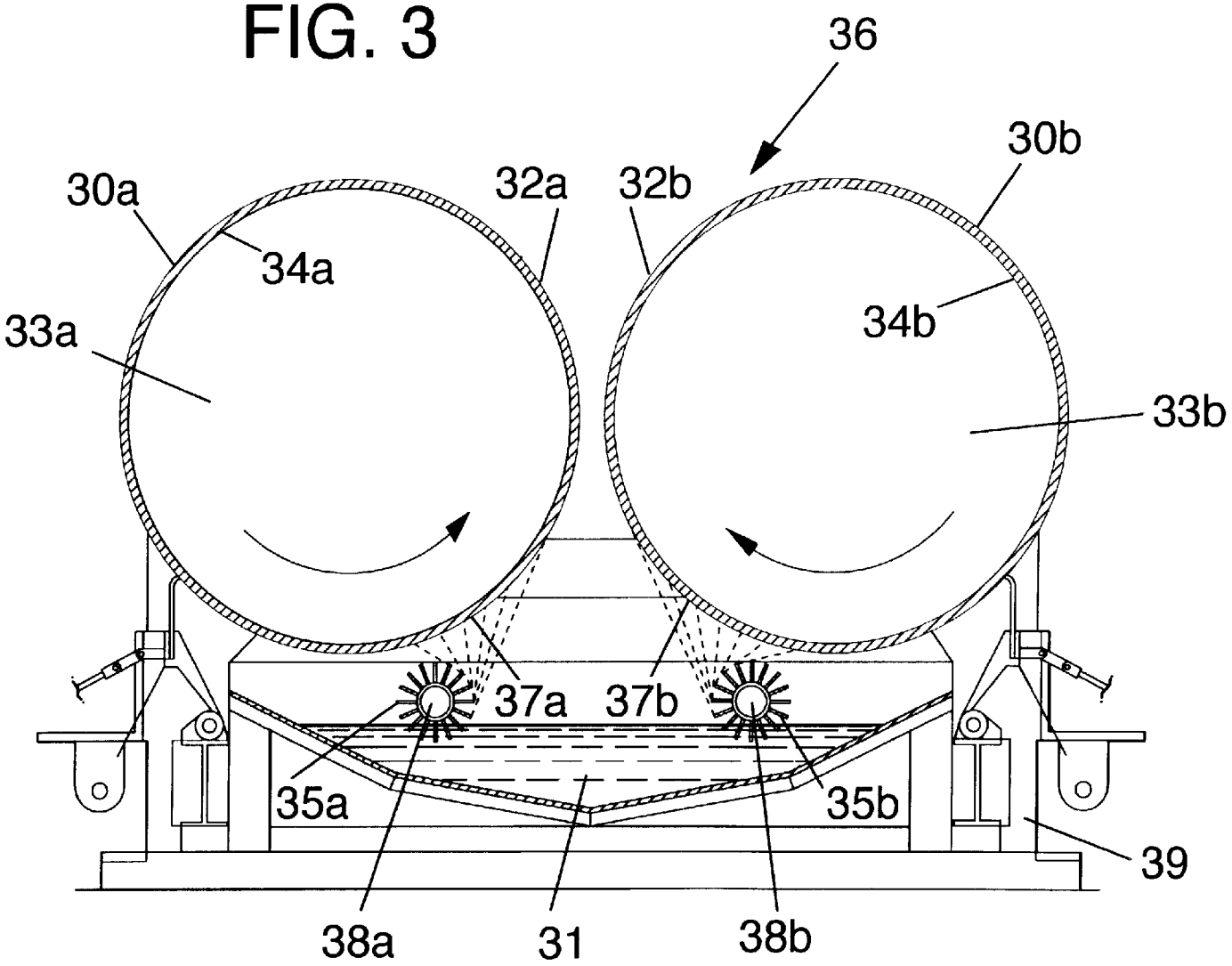
FIG. 3 is a cutaway side elevation view of another embodiment of drum chilling apparatus useful in the practice of our invention.

Referring to FIG. 3, FIG. 3 sets forth a twin drum chilling apparatus with splash feed. Pre-selected perfume composition-fat-surfactant melt 31 is fed from vessel 14 (FIG. 1B) through line 1010 past control valve 1009. Drum 30*a* rotating in counterclockwise fashion and drum 30*b* rotating in clockwise fashion have their inner surfaces cooled by a cooling spray impinging upon the inner walls, 34*a* (drum 30*a*) and 34*b* (drum 30*b*). Simultaneously, liquid melt/pre-selected perfume composition from 31 is splash fed onto the outer surfaces of the drums 30*a* and 30*b* at locations 37*a* and 37*b* using splash feeders 38*a* and 38*b*, respectively, which each have splashing fins 35*a* and 35*b*. The dried flakes on the outer surface of the drum are scraped off, usually via an automatic scraper, and the flakes are located on surfaces 32*a* and 32*b* of drums 30*a* and 30*b*, respectively. The overall twin drum chilling apparatus with splash feed is held on frame 39, with the overall apparatus being indicated by reference numeral 36.

Figure 4:
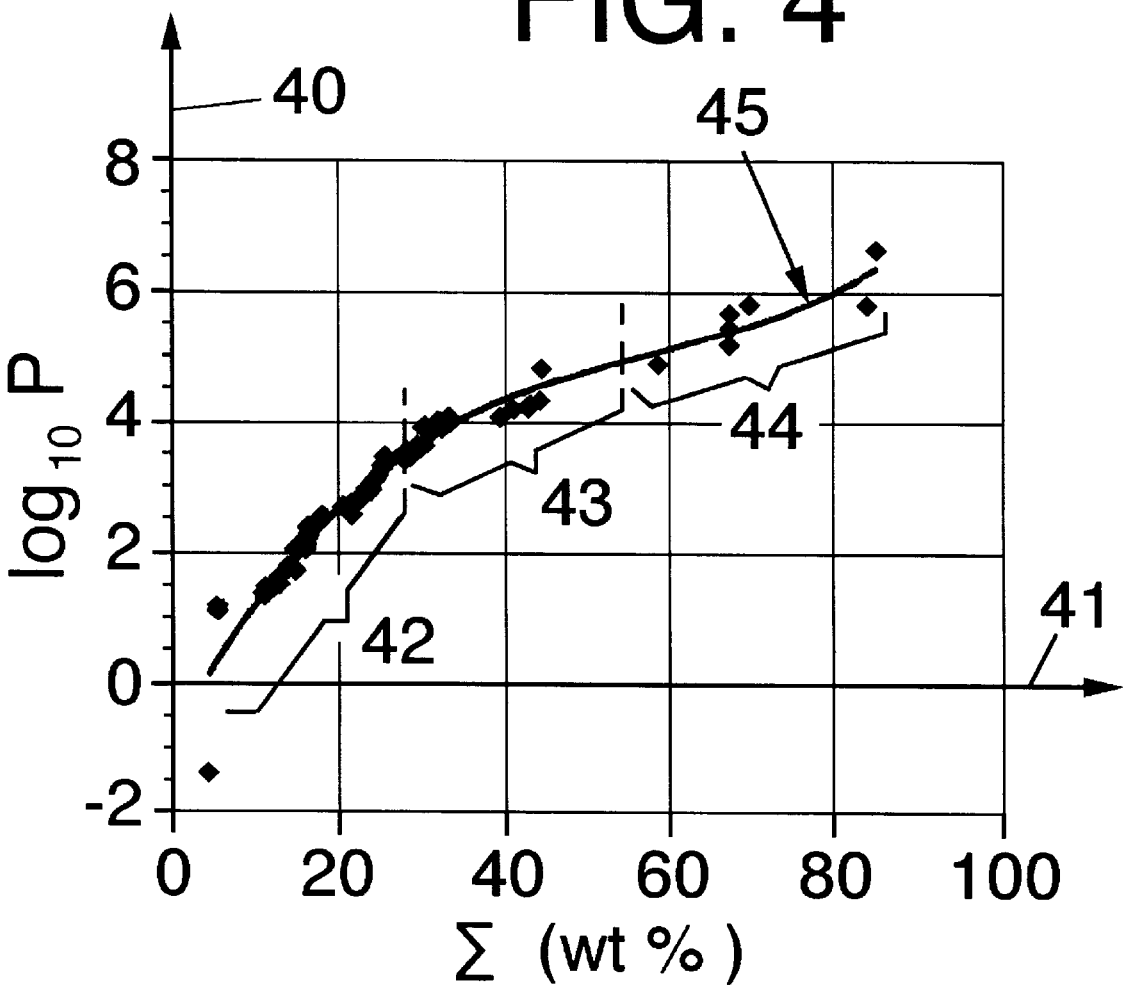
FIG. 4 is a graph in the X-Y plane setting forth a plot for "Fragrance No. 1" of various components with $\log_{10}P$ of each component taken along the Y axis and cumulative weight percent, Σ(wt. %), taken along the X axis for each component.

Referring to FIG. 4, for the pre-selected fragrance formulation, "Fragrance No. 1, " the Y axis for the "$\log_{10}$P" for each of the pre-selected formulation ingredients is indicated by reference numeral 40, and the X axis for the cumulative weight percentages is indicated by reference numeral 41. The "low $\log_{10}$P"0 section of the graph is indicated by reference numeral 42; the "intermediate $\log_{10}$P" section of the graph is indicated by reference numeral 43; and the "high $\log_{10}$P" section of the graph is indicated by reference numeral 44, with the overall graph illustrating the algorithm being indicated by reference numeral 45.

Figure 5:
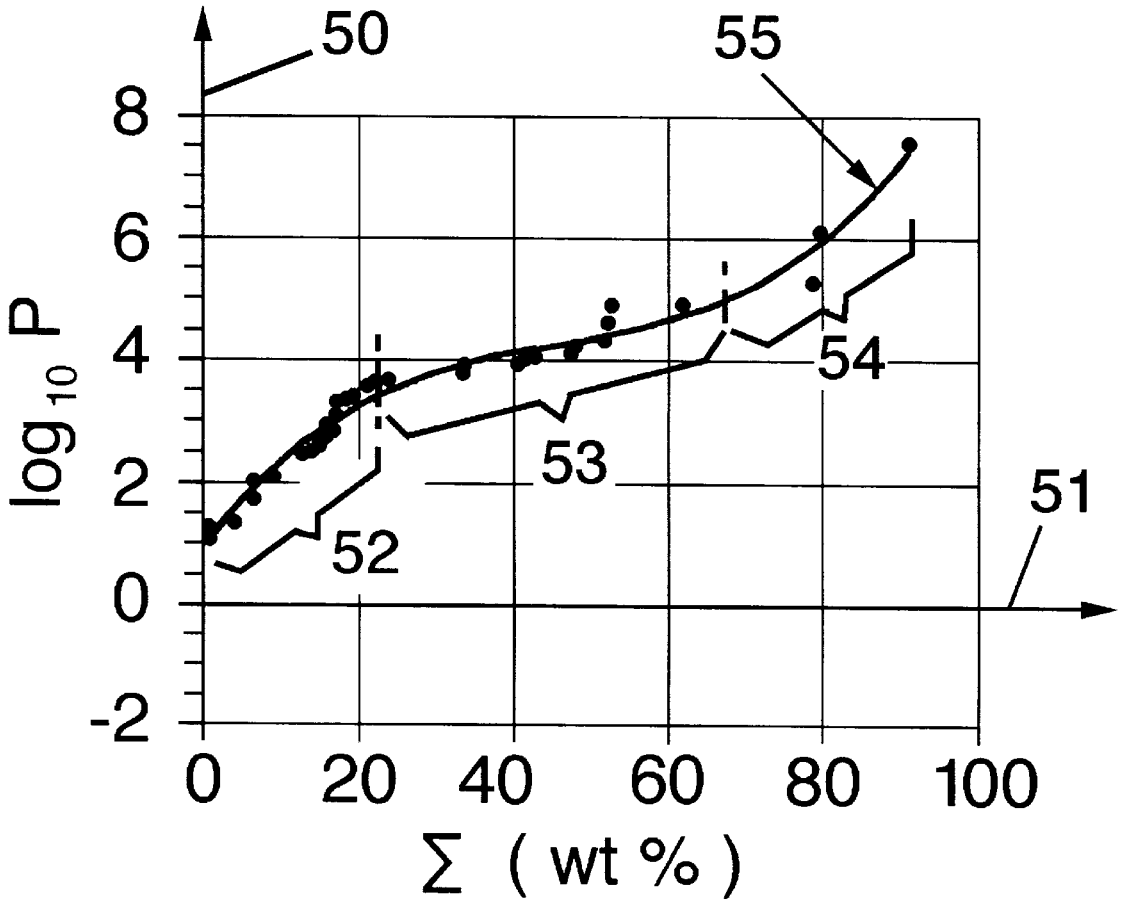
FIG. 5 is a graph similar to that of FIG. 4 for the formulation, "Fragrance No. 2."

By the same token, referring to FIG. 5, the Y axis for "$\log_{10}$P" for each of the ingredients is indicated by reference numeral 50, and the X axis for cumulative weight percent, Σ(wt. %), is indicated by reference numeral 51. The "low $\log_{10}$P" section of the graph is indicated by reference numeral 52; the "intermediate $\log_{10}$P" section of the graph is indicated by reference numeral 53; and the "high $\log_{10}$P" section of the graph is indicated by reference numeral 54, and the overall graph for the algorithm for "Fragrance No. 2" is indicated by reference numeral 55.

Figure 6:
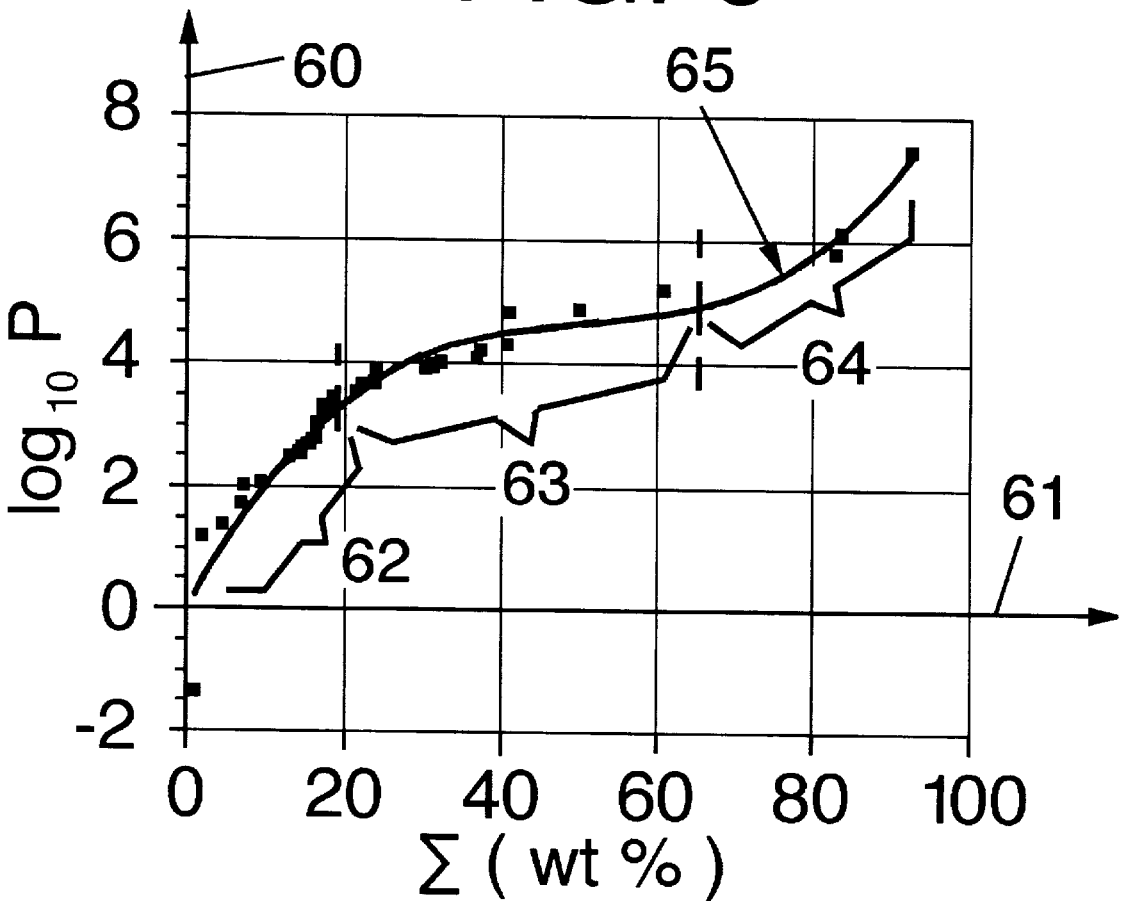
FIG. 6 is a graph similar to that of FIG. 4 for the formulation, "Fragrance No. 3."

By the same token, referring to FIG. 6, the Y axis for "$\log_{10}$P" for each of the ingredients of the formulation is indicated by reference numeral 60, and the X axis for cumulative weight percent of each of the ingredients, Σ(wt. %), is indicated by reference numeral 61. The "low $\log_{10}$P" section of the graph 65 is indicated by reference numeral 62; the "intermediate $\log_{10}$P" section of the graph is indicated by reference numeral 63; and the "high $\log_{10}$P" section of the graph is indicated by reference numeral 64.

Figure 7:
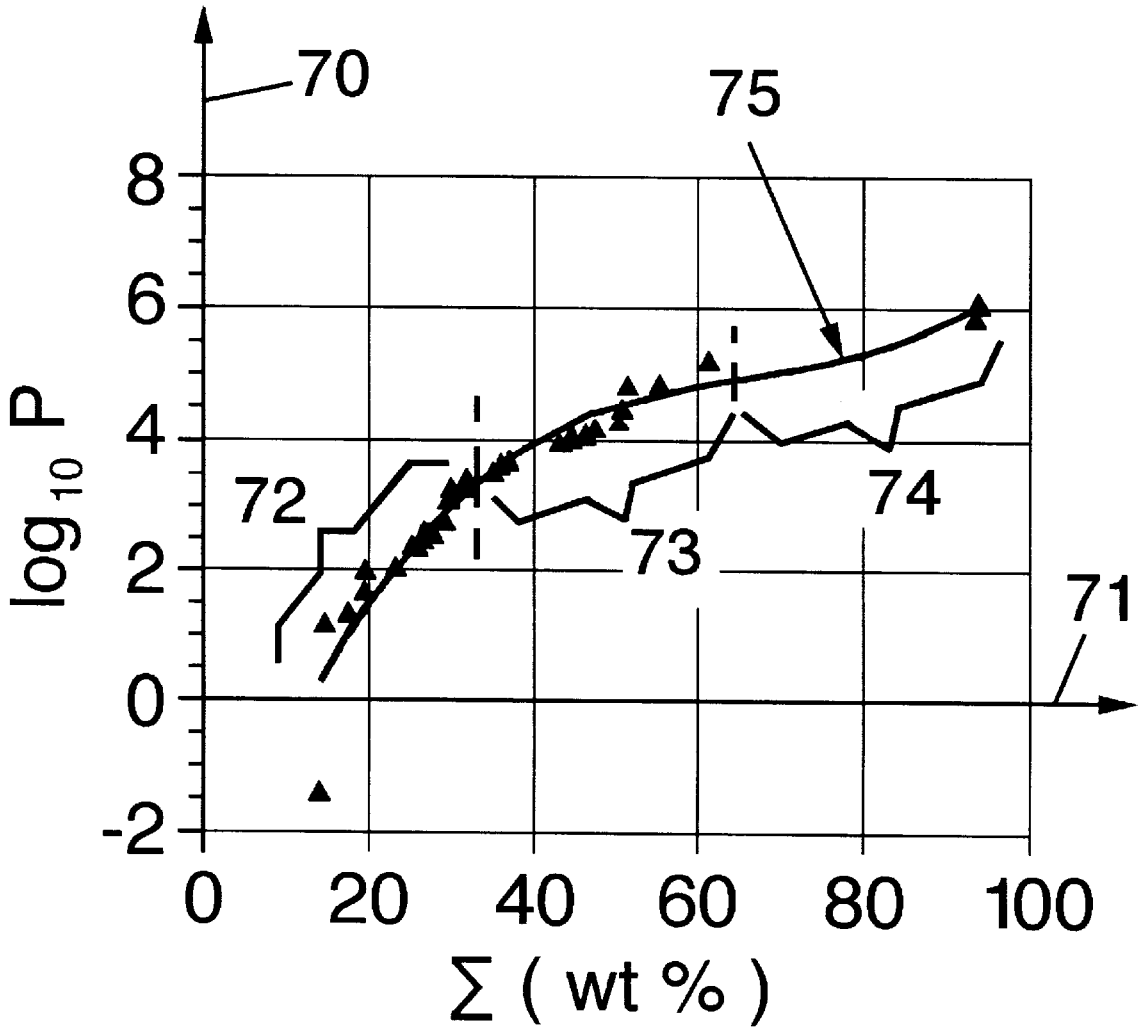
FIG. 7 is a graph similar to that of FIG. 4 for the formulation, "Fragrance No. 4."

Referring to FIG. 7, the Y axis for "$\log_{10}$P" is indicated by reference numeral 70, and the X axis for cumulative weight percent, Σ(wt. %), is indicated by reference numeral 71. The "low $\log_{10}$P" section of the graph 75 is indicated by reference numeral 72; the "intermediate $\log_{10}$P" section of the graph is indicated by reference numeral 73; and the "high $\log_{10}$P" section of the graph is indicated by reference numeral 74.

Figure 8:
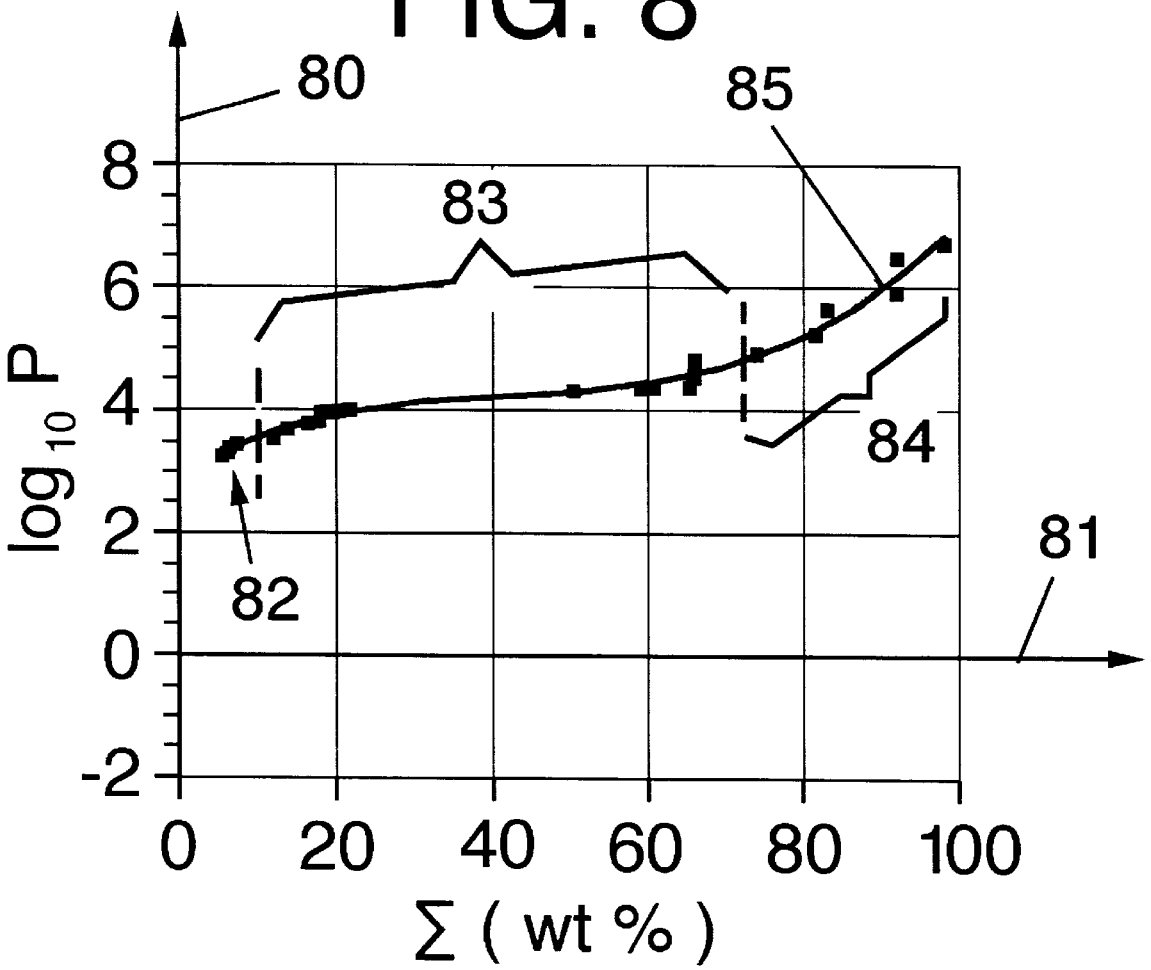
FIG. 8 is a graph similar to that of FIG. 4 for the formulation, "Fragrance No. 5."

Referring to FIG. 8, the Y axis for "$\log_{10}$P" is indicated by reference numeral 80, and the X axis for cumulative weight percent of each of the components of the Fragrance formulation No. 5 is indicated by reference numeral 81. The "low $\log_{10}$P" section of the graph is indicated by reference numeral 82; the "intermediate $\log_{10}$P" section of the graph is indicated by reference numeral 83; and the "high $\log_{10}$P" section of the graph is indicated by reference numeral 84. The overall graph is indicated by reference numeral 85.

Figure 9:
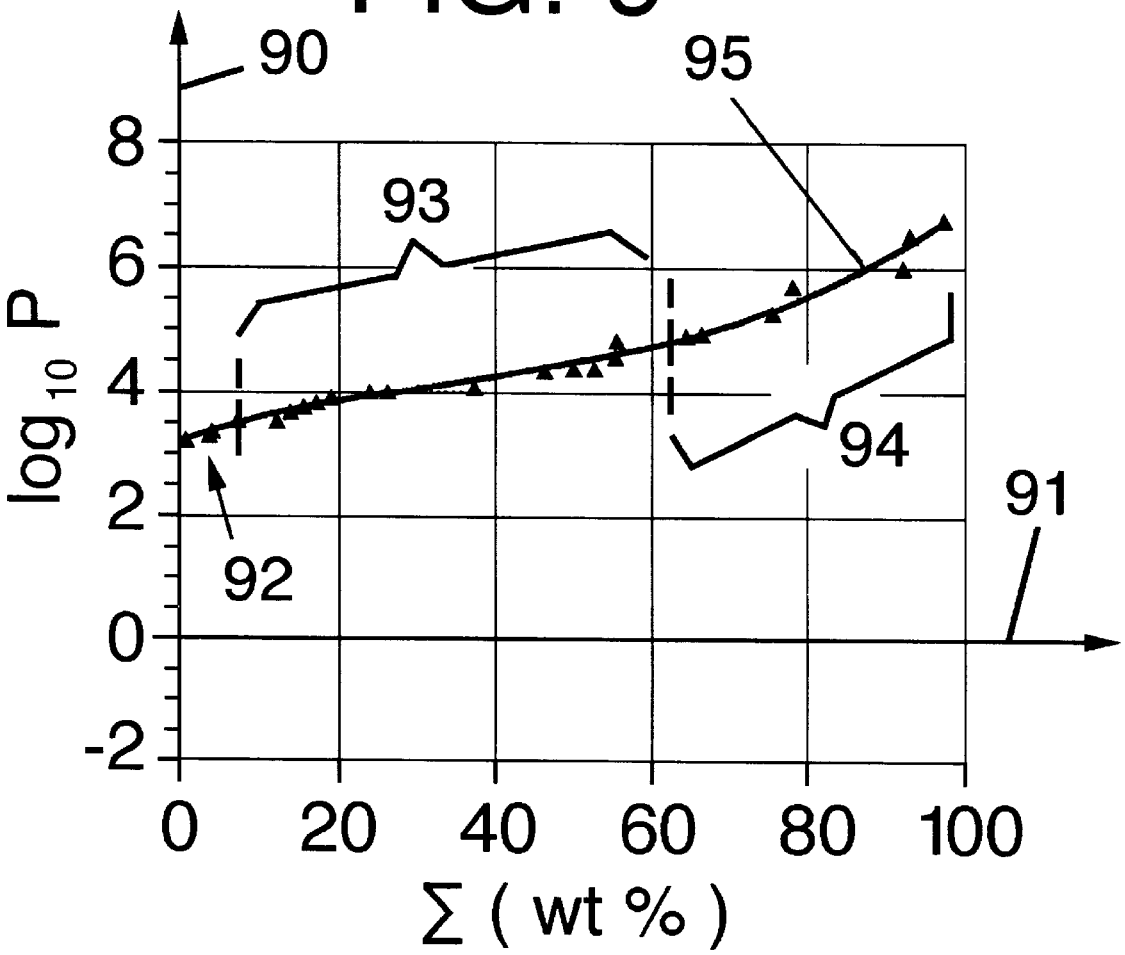
FIG. 9 is a graph similar to that of FIG. 4 for the formulation, "Fragrance No. 6."

Referring to FIG. 9, the Y axis for "$\log_{10}$P" for each of the ingredients of the formulation is indicated by reference numeral 90, and the X axis for cumulative weight percent of each of the formulation ingredients, Σ(Wt. %), is indicated by reference numeral 91. The "low $\log_{10}$P" section of the graph 95 is indicated by reference numeral 92; the "intermediate $\log_{10}$P" section of the graph is indicated by reference numeral 93; and the "high $\log_{10}$P" section of the graph is indicated by reference numeral 94.

Figure 10:
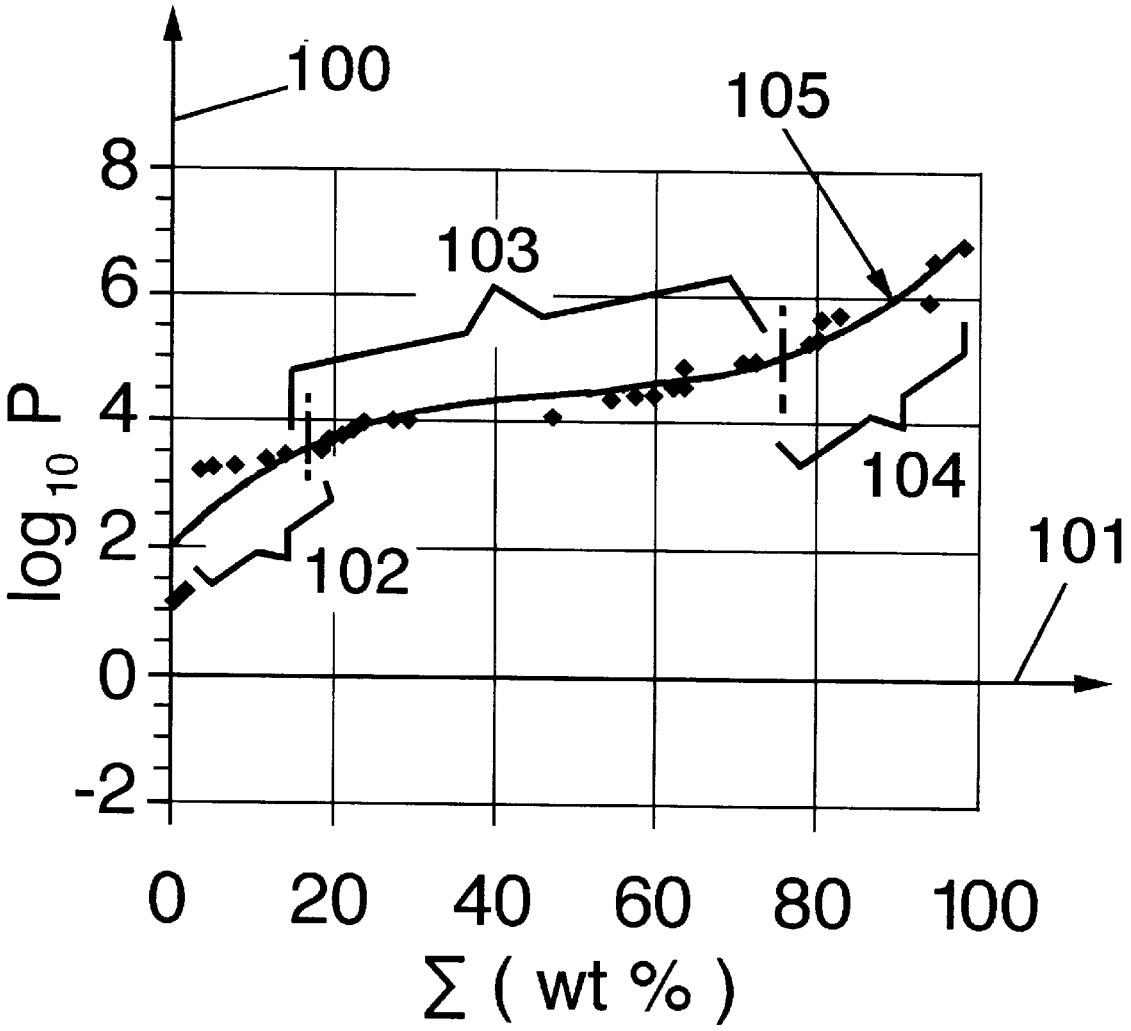
FIG. 10 is a graph similar to that of FIG. 4 for the formulation, "Fragrance No. 7."

Referring to FIG. 10 for "Fragrance No. 7," the Y axis for "$\log_{10}$P" for each of the ingredients of the formulation for Fragrance No. 7 is indicated by reference numeral 100, and the X axis for cumulative weight percent, Σ(wt. %), for each of the ingredients of Fragrance No. 7 is indicated by reference numeral 101. The "low $\log_{10}$P" section of graph 105 is indicated by reference numeral 102; the "intermediate $\log_{10}$P" section of graph 105 is indicated by reference numeral 103; and the "high $\log_{10}$P" section of graph 105 is indicated by reference numeral 104.

Figure 11:
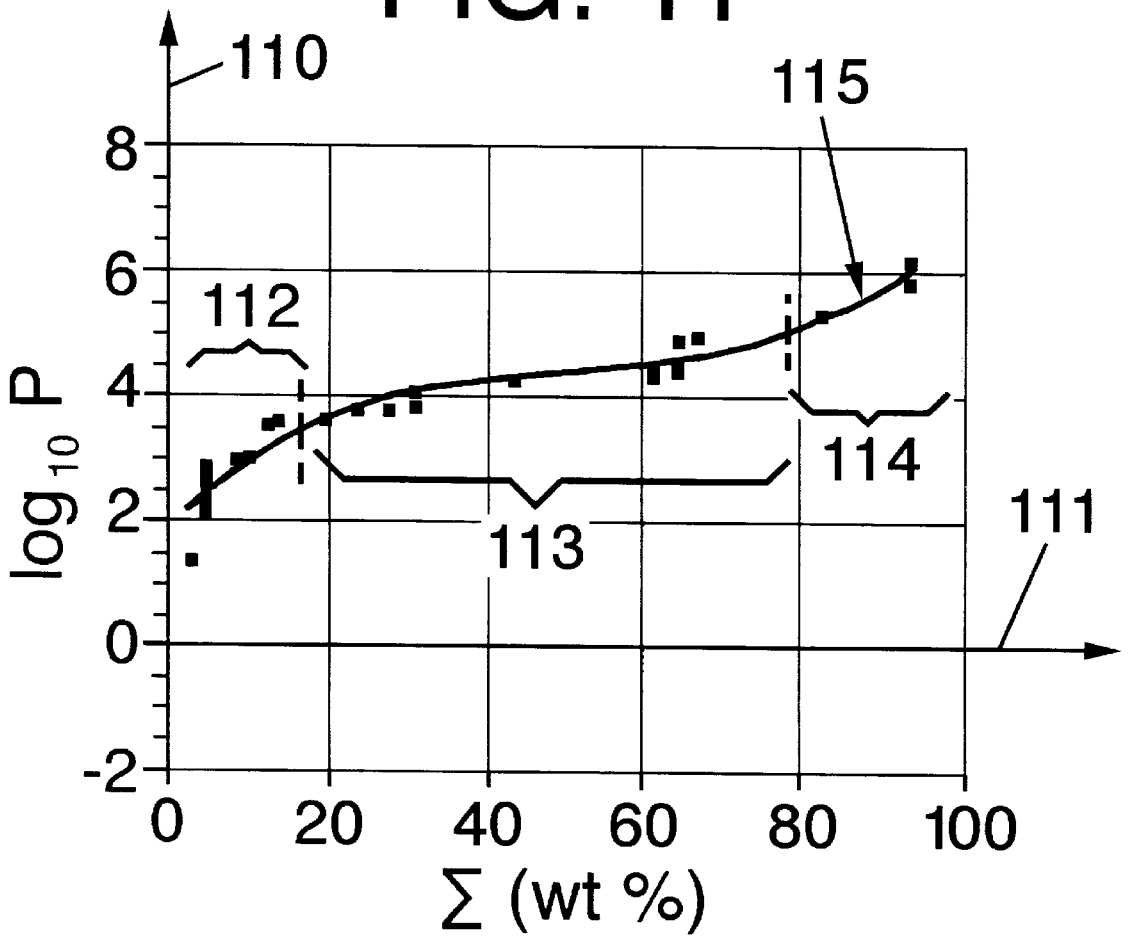
FIG. 11 is a graph similar to that of FIG. 4 for the formulation, "Fragrance No. 8."

Referring to FIG. 11, the graph illustrating the algorithm for Fragrance No. 8, the Y axis for "$\log_{10}$P" for each of the ingredients of Fragrance No. 8 is indicated by reference numeral 110, and the X axis for cumulative weight percent of each of the ingredients for Fragrance No. 8 is indicated by reference numeral 111. The "low $\log_{10}$P" region of graph 115 for Fragrance No. 8 is indicated by reference numeral 112; the "intermediate $\log_{10}$P" section of graph 115 is indicated by reference numeral 113; and the "high $\log_{10}$P" section of graph 115 for Fragrance No. 8 is indicated by reference numeral 114.

Figure 12:
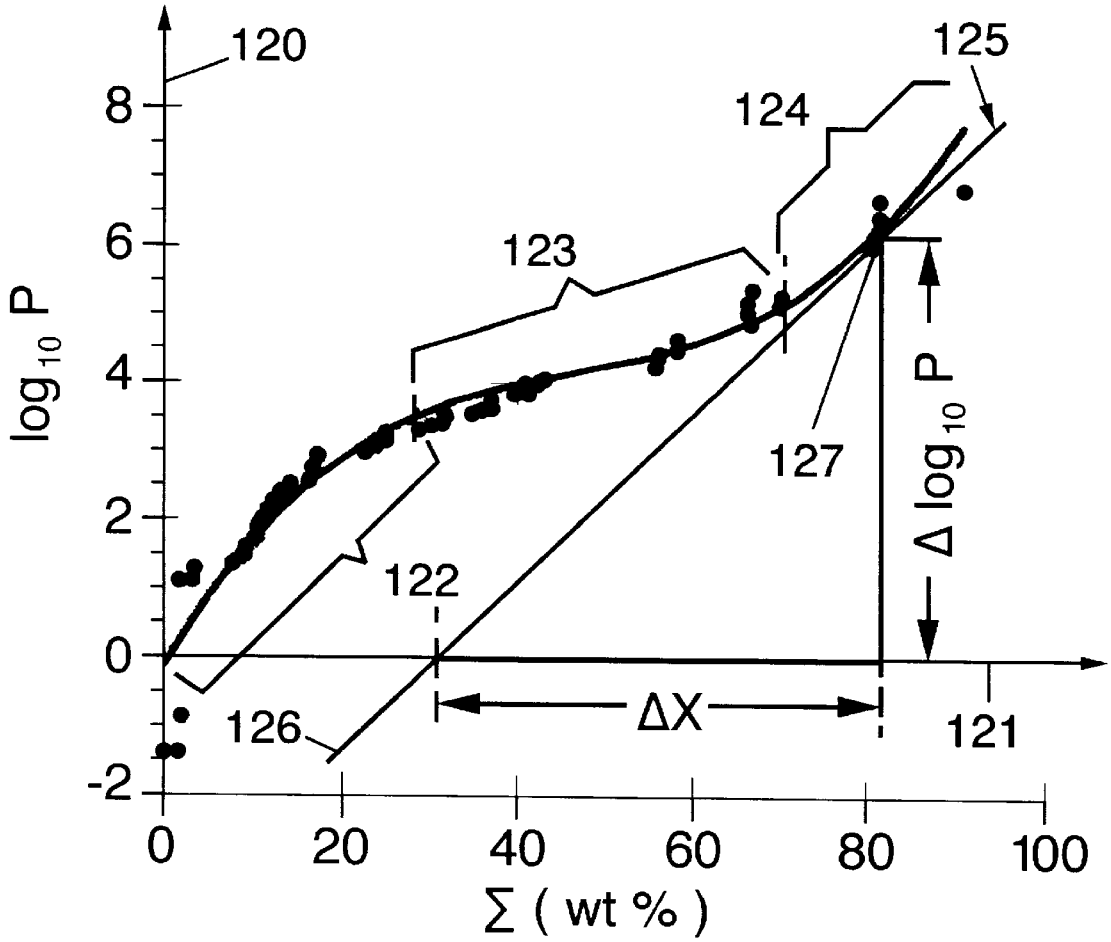
FIG. 12 is a graph similar to that of FIG. 4 for the formulation, "Fragrance No. 9," and also showing the method for use in connection with the mathematical algorithm, $$\log_{10} P=M_0+M_1x+M_2x^2+M_3x^3;$$

Referring to FIG. 12, the Y axis for "$\log_{10}$P" for each of the ingredients of Fragrance No. 9 is indicated by reference numeral 120, and the X axis for cumulative weight percent of each of the ingredients of Fragrance No. 9 Σ(wt. %) is indicated by reference numeral 121. The "low $\log_{10}$P" section of graph 125 is indicated by reference numeral 122; the "intermediate $\log_{10}$P" region of graph 125 is indicated by reference numeral 123; and the "high $\log_{10}$P" region of graph 125 is indicated by reference numeral 124. The tangent slope to point 127, where the cumulative weight percent is 80 and the $\log_{10}$P is 6, is indicated by reference numeral 127; and the tangent slope thereto is indicated by line 126, with the tangent slope shown by the relationships:

$$M_{3j} = \frac{\Delta \log_{10} P_i}{\Delta x}; \quad M_{3j} = \frac{\Delta \log_{10} P_i}{\Delta \Sigma(\text{wt. } \%)_i}.$$

The photo micrographs of the flakes in FIGS. 13A, 13B and 13C show flakes 130*a*, 130*b* and 130*c*, respectively. The photo micrograph of the cryogenically ground particles of FIG. 14 shows particle 140.

Referring again to the drum chilling apparatus of FIGS. 15A and 15B, reference numerals 152 and 152' show the adjustable knife control for the apparatus where a knife blade and holder, either manual or pneumatic, provide various adjustments to insure through removal of the flake product from the drums. Reference numerals 153 and 153' show self-aligning main bearings, removable caps and replacement bushings. Reference numerals 154 and 154' for FIGS. 15A and 15B, respectively, show the steel support drum, main bearings, knife holder and feed pan forming part of the enclosure.

Reference numerals 155 and 155' show variable speed drives which provide maximum flexibility in controlling drum rotation speeds (e.g., preferably 6–8 rpm). Reference numerals 156 and 156' show the actual drums which may be fabricated from cast iron, fabricated steel, stainless steel or other alloys. End scrapers are used to prevent product accumulation when dip feeding as shown in FIG. 2.

Reference numerals 157 and 157' show knives of tempered tool steel which effect thorough removal of flake product from the drums with minimum power consumption. The knife pressure may be applied mechanically by screw operated hand wheels or by pneumatic cylinders. Reference numerals 158 and 158' show flake breakers and shredders as the flakes are emitted from the surface of the drums.

Referring to FIG. 16, FIG. 16 sets forth an alternative drum chilling apparatus useful in the practice of our invention. Reference numeral 166 shows the drum itself. Reference numeral 162 sets forth the adjustable knife control, and reference numeral 165 shows the variable speed drive engine (preferably 6–8 rpm).

Referring to FIG. 17, FIG. 17 shows a cutaway side elevation schematic diagram of the inner part of the drum of the drum chilling apparatus of FIG. 16, for example. Reference numeral 172 shows the cooling spray head where water at 5–20° C. is sprayed from openings 175 onto inner drum surface 174, thereby cooling outer drum surface 171, the water spray shown by reference numeral 173. Since the outer surface 171 is cooled, the fragrance-fat-surfactant melt solidifies and forms flakes on the outer surface 171.

The following Example A sets forth a fragrance composition useful in practicing the process and formulating the product of our invention. The following Example I sets forth a process for producing the product of our invention containing fat, surfactant and fragrance formulation of Example A. The following Example II sets forth the creation and consumer evaluation of a detergent carrier system of our invention using the product of Example I.

EXAMPLE A

The following fragrance formulation is prepared in accordance with the algorithm:

$$\log_{10} P = M_0 + M_1 x + M_2 x^2 + M_3 x^3;$$

x =Σ( wt. %); and the algorithm:

$$\sum_{i=10}^{1000} \log_{10} P_i = \sum_{j=10}^{1000} [M_{oj} + M_{1j} x_j + M_{2j} x_j^2 + M_{3j} x_j^3]:$$

| Ingredients | Parts by Weight |
|---|---|
| Ambrettolide (high $\log_{10}$P) | 4.0 |
| β-Caryophyllene (high $\log_{10}$P) | 4.8 |
| Cadinene (high $\log_{10}$P) | 6.2 |
| Cyclohexyl salicylate (high $\log_{10}$P) | 2.8 |
| Diphenyl oxide (intermediate $\log_{10}$P) | 4.2 |
| Ethyl brassylate (intermediate $\log_{10}$P) | 4.8 |
| Geranyl anthranilate (intermediate $\log_{10}$P) | 2.8 |
| Hexenyl salicylate (intermediate $\log_{10}$P) | 1.3 |
| 4-Phenyl-2-hexenol (low $\log_{10}$P) | 8.4 |
| Benzaldehyde (low $\log_{10}$P) | 7.2 |
| Benzyl acetate (low $\log_{10}$P) | 4.0 |
| Geraniol (low $\log_{10}$P) | 7.4 |
| Indole (low $\log_{10}$P) | 0.05 |

The resulting fragrance formulation follows the algorithm according to the graph of FIG. 6.

EXAMPLE I

60 Grams of DURKEE® D17 Fat (partially hydrogenated soybean oil) is melted at 125° C. 20 Grams of SPAN® 65 (sorbitan tristearate) is melted at 125° C. The SPAN® 65 and fat melts are combined. 20 Grams of the fragrance of Example A is then added to the molten fat/SPAN® 65 mixture at 125° C. under 8 atmospheres pressure. The resulting fragrance-surfactant-fat mixture is then cooled while maintained in a liquid state and placed into location 21 using laboratory size, drum chilling apparatus of FIG. 2. The drum chilling apparatus is operated at 5.5 rpm, yielding chilled flakes. The chilled flakes are then frozen with liquid nitrogen and ground using a Wiley Mill and sieved to form particle size having the following analysis:

Particle size analysis:

| Mesh # | Particle Size Range |
|---|---|
| +25 | particles > 710 μm |
| +35–25 | 500 to 710 μm |
| +45–35 | 355 to 500 μm |
| −120 | particles < 125 μm |
| −230 | particles < 63 μm |

EXAMPLE II

Detergent Carrier System

Summary

Three paired comparison tests were conducted to directly compare cloth samples (3"×3"65/35 polyester/cotton fabric swatches) washed in the following detergent samples:

(i) Neat at 0.55 % in TIDE® FREE (trademark of the Procter & Gamble Company of Cincinnati, Ohio); and (ii) 20% in the product produced according to Example I, supra, at 0.55% in TIDE® FREE.

Cloth samples were line-dried for 24 hours and then evaluated at three stages: immediately after drying; at one week after drying; and at two weeks after drying. Test results indicate that the cloth samples washed with the encapsulated fragrance of Example I are significantly more intense than the control samples washed with the Neat fragrance immediately after drying and at week one. At week two, there is no significant difference between the two samples, although the cloth washed with the encapsulated fragrance of Example I is directly more intense. The test method is presented below, and test results are presented following the method:

Method

Cloth samples (3"×3" fabric swatches, 65/35 polyester/cotton) were used. For the two week holding time in between evaluations, the cloth samples were stored in open plastic containers in rooms with controlled air flow. 49 to 52 Panelists completed each paired comparison test. Each cloth sample was placed on foil-line trays for evaluation. Panelists were instructed to pick up the trays to smell the samples. They were also instructed to smell the samples in the order listed on their ballot and answer the question, "Which sample smells stronger?" Presentation order was completely balanced for this test.

The laundry samples were prepared at a 0.55% effective fragrance concentration using the fragrance of Example A, supra. Towels used were 65% polyester and 35% cotton. Eight towels were placed in the washing machine with 85 grams of powder detergent sample. The following washing machine cycle was used:

Cycle: normal, 14 minutes;

Water level: high; and

Water temperature: warm/cold.

Towels were line-dried overnight in a fragrance-free room and evaluated for 24-hour and one week substantivity. Duplicate consumer panel tests were conducted using 48 to 54 panelists. The results indicate that the encapsulated drum-chilled product of Example I performs much better than the control as shown below. The same particles were spray-chilled and tested for substantivity, but did not perform as well.

Sample size: 100 grams;

Fragrance level: 0.55%; and

Composition content: 60% fat, 20% surfactant and 20% fragrance of Example A.

Sample Preparation: Encapsulated Capsules 97.25 Grams of TIDE® unfragranced base was placed in a jar. 2.75 Grams of encapsulated fragrance of Example I was added thereto and the resulting mixture was mixed for one hour in a Turbula mixer.

Neat Sample 0.55 Grams of the Neat fragrance oil of Example A was added to 99.45 grams of TIDE® unfragranced base in a jar. The resulting fragrance oil and TIDE® unfragranced base were mixed for one hour in a Turbula mixer.

TABLE IV

PAIRED COMPARISON TEST RESULTS

| Samples | Number of Choices | Number Needed for Significance |
|---|---|---|
| Day 1 | | |
| Sample 4 Batch | 51* | 35 |
| vs. | | |
| Sample 1 Control | 3 | |
| Day 7 | | |
| Sample 4 Batch | 46* | 36 |

TABLE IV-continued

PAIRED COMPARISON TEST RESULTS

| Samples | Number of Choices | Number Needed for Significance |
|---|---|---|
| vs. | | |
| Sample 1 control | 9 | |
| Day 14 | | |
| Sample 4 Batch | 34* | 32 |
| vs. | | |
| Sample 1 Control | 14 | |

*Significant based on a binomial distribution ($p < 0.05$).

TABLE V

PAIRED COMPARISON TEST RESULTS

| Samples | Number of Choices | Number Needed for Significance |
|---|---|---|
| Day 1 | | |
| Sample 2 Batch | 32* | 32 |
| vs. | | |
| Sample 1 Control | 16 | |
| Day 8 | | |
| Sample 2 Batch | 40* | 34 |
| vs. | | |
| Sample 1 Control | 12 | |
| Day 16 | | |
| Sample 2 Batch | 29 | 32 |
| vs. | | |
| Sample 1 Control | 20 | |

*Significant based on a binomial distribution ($p < 0.05$).

TABLE VI

PAIRED COMPARISON TEST RESULTS

| Experiment | Number of Choices | Number Needed for Significance |
|---|---|---|
| Day 1 | | |
| Sample 1 | 22 | 32 |
| vs. | | |
| Control | 27 | |
| Week 1 | | |
| Sample 1 | 23 | 32 |
| vs. | | |
| Control | 26 | |

What is claimed is:

1. Apparatus used for producing a fragrance-containing long lasting solid particle of improved substantivity for incorporation into:

(i) laundry detergents;

(ii) fabric softener compositions; and (iii) drier-added fabric softener articles consisting essentially of:

(A) first containment means for maintaining a fat component selected from the group consisting of partially hydrogenated soybean oil, partially hydrogenated cotton seed oil and partially hydrogenated palm oil in the molten state;

(B) heating means directly associated with said first containment means for heating said fat component located within said first containment means to an elevated temperature sufficient to form a first molten melt thereof;

(C) second containment means for maintaining a solid surface active agent which is a surfactant of HLB of from about 1 up to 3, defined as a mixture of compounds having the structures:

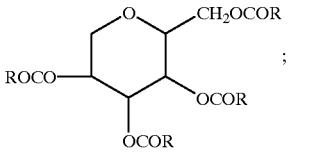

;

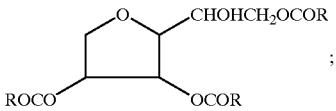

; and

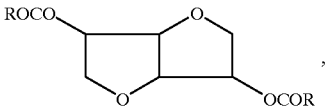

, wherein R is $C_{11}$–$C_{17}$ alkyl or alkenyl in the molten state;

(D) second heating means directly associated with said second containment means for heating said surface active agent to form a second molten melt thereof;

(E) (i) data processing means directly associated with and directly communicating with liquid feeding means for feeding fragrance formulation components into third containment means; and (ii) third containment means for preparing a fragrance formulation containing at least ten pre-selected components by following a mathematical algorithm whereby:

(a) the cumulative sum of the weight percents of each of the fragrance components is a function of the $\log_{10}P$ of each fragrance component as defined by the equation:

$$\log_{10} P=M_0+M_1x+M_2x^2+M_3x^3;$$

x =Σ(wt. %)

(b) the totality of the fragrance components has a pleasantness perception value of greater than 80 on a scale of 1–100; and (c) the totality of the fragrance components has an intensity perception value of greater than 80 on a scale of 1–100, wherein:

is the water-n-octanol partition coefficient for a single fragrance component in the fragrance formulation; $\log_{10}P$ is measured on the Y axis; x is the cumulative sum of weight percentages of fragrance components in the fragrance formulation for a given value of $\log_{10}P$ shown thusly: Σ(wt. %); $M_0$ is the $\log_{10}P$ intercept of the curve defining the algorithm in the X-Y plane on the Y axis; $M_1$ is the root mean square of the tangent slopes to at least three points on the curve defining the algorithm at the "low" $\log_{10}P$ region of the curve defining the algorithm in the X-Y plane; $M_2$ is the root mean square of the tangent slopes to at least three points on the curve defining the algorithm at the "intermediate" $\log_{10}P$ region of the curve defining the algorithm in the X-Y plane; $M_3$ is the root mean square of the tangent slopes to at least three points on the curve defining the algorithm in the X-Y plane at the "high" $\log_{10}P$ region of the curve defining the algorithm in the X-Y plane; the "low" $\log_{10}P$ region of the curve is defined thusly: $-2<\log_{10}P\leqq 3.5$; the "intermediate" $\log_{10}P$ region of the curve is defined thusly: $3.5<\log_{10}P\leqq 5$; and the "high" $\log_{10}P$ region of the curve is defined thusly: $5<\log_{10}P\leqq 8$;

(F) second liquid feeding means, fourth containment means and mixing means directly associated with said fourth containment means for combining said first and second melts with said fragrance formulation previously formed in said third containment means and mixing means for uniformly dispersing said fragrance formulation in the combined melt of said fat component and said surfactant; whereby said first and second melts and said fragrance formulation are fed via said second feeding means into said fourth containment means;

(G) drum chilling means and fifth feeding means for rapidly cooling the resulting mixture of melts to form a solid material containing said fat component, said surfactant and said fragrance formulation, whereby said mixture of first and second melts and said fragrance formulation is transported from said fourth containment means into said drum chilling means; and (H) particle forming means associated with the output of said drum chilling means for forming solid particles thereof, each of which particle has an effective diameter of from about 0.3 up to about 0.8 microns; and each of which particle contains from about 1.0 up to about 20.0% by weight of said fragrance formulation; from about 40 up to about 99% by weight of said fat component; and from about 1 up to about 60% by weight of said surfactant.

* * * * *